US009235188B2

(12) United States Patent
Moon et al.

(10) Patent No.: US 9,235,188 B2
(45) Date of Patent: Jan. 12, 2016

(54) CARTRIDGE AND ELECTROPHOTOGRAPHIC IMAGE FORMING APPARATUS USING THE SAME

(71) Applicant: SAMSUNG ELECTRONICS CO., LTD., Suwon-si, Gyeonggi-do (KR)

(72) Inventors: Ji-won Moon, Suwon-si (KR); Joon-hee Kim, Seoul (KR); Oh-dug Kwon, Suwon-si (KR); Ho-jin Jang, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/462,737

(22) Filed: Aug. 19, 2014

(65) Prior Publication Data

US 2015/0261176 A1 Sep. 17, 2015

(30) Foreign Application Priority Data

Mar. 12, 2014 (KR) ..... 10-2014-0029162

(51) Int. Cl.
*G03G 15/00* (2006.01)
*G03G 21/16* (2006.01)

(52) U.S. Cl.
CPC ..... *G03G 21/1633* (2013.01)

(58) Field of Classification Search
CPC ..... G03G 21/1633
USPC ..... 399/90
See application file for complete search history.

(56) References Cited

U.S. PATENT DOCUMENTS

| | | | | |
|---|---|---|---|---|
| 6,079,816 | A * | 6/2000 | Nakamura et al. | 347/55 |
| 7,978,997 | B2 | 7/2011 | Tokuda | |
| 2003/0215248 | A1 | 11/2003 | Silence et al. | |
| 2007/0098437 | A1 * | 5/2007 | Kaiga | 399/111 |
| 2008/0240776 | A1 | 10/2008 | Ishikawa | |
| 2009/0214249 | A1 | 8/2009 | Lee et al. | |

(Continued)

FOREIGN PATENT DOCUMENTS

| | | |
|---|---|---|
| JP | 2002-365863 | 12/2002 |
| JP | 2003-195723 | 7/2003 |
| JP | 2004-46808 | 2/2004 |

(Continued)

OTHER PUBLICATIONS

PCT International Search Report mailed Nov. 28, 2014 in corresponding International Patent Application No. PCT/KR2014/007482.

(Continued)

*Primary Examiner* — Francis Gray
(74) *Attorney, Agent, or Firm* — Staas & Halsey LLP

(57) ABSTRACT

A cartridge is attached to or detached from a main body of an image forming apparatus that has an opening portion and a door that opens or closes the opening portion. The cartridge includes: a memory unit with a contact portion via which the cartridge is connected to the main body to transmit information of the cartridge to the main body; and a moving member on which the contact portion is mounted, wherein the moving member is moved to a first position where the contact portion is hidden inside the cartridge and a second position where the contact portion protrudes out of the cartridge to be connected to a connection portion provided in the main body, the moving member being moved to the second position in connection with closing of the door.

39 Claims, 27 Drawing Sheets

(56) References Cited

U.S. PATENT DOCUMENTS

| | | | | |
|---|---|---|---|---|
| 2011/0091222 | A1* | 4/2011 | Kim et al. | 399/9 |
| 2014/0072333 | A1* | 3/2014 | Yamashita | 399/110 |

FOREIGN PATENT DOCUMENTS

| | | | | |
|---|---|---|---|---|
| JP | 2004-61596 | | 2/2004 | |
| JP | 2004061596 | A * | 2/2004 | G03G 21/18 |
| JP | 2006-221010 | | 8/2006 | |
| JP | 2007-79284 | | 3/2007 | |
| JP | 2008-90124 | | 4/2008 | |
| JP | 2011-164398 | | 8/2011 | |
| KR | 10-2007-0047177 | | 5/2007 | |

OTHER PUBLICATIONS

European Office Action Issued May 26, 2015 in corresponding European Application No. 15150365.3.

European Search Report Issued Apr. 28, 2015 in corresponding European Application No. 15150365.3.

Korean Office Action mailed Jun. 15, 2015 in corresponding Korean Application No. 10-2014-0029162.

Korean Notice of Allowance dated Oct. 21, 2015 in corresponding Korean Patent Application No. 10-2014-0029162.

* cited by examiner

CARTRIDGE AND ELECTROPHOTOGRAPHIC IMAGE FORMING APPARATUS USING THE SAME

CROSS-REFERENCE RELATED APPLICATION

This application claims the benefit of Korean Patent Application No. 10-2014-0029162, filed on Mar. 12, 2014, in the Korean Intellectual Property Office, the disclosure of which is incorporated herein in its entirety by reference.

BACKGROUND

1. Field

One or more embodiments relate to an image forming apparatus capable of forming an image on a recording medium and a cartridge that is attached to or detached from the image forming apparatus.

2. Description of the Related Art

An image forming apparatus using electrophotography prints an image on a recording medium by supplying toner to an electrostatic latent image formed on a photoreceptor to form a visible toner image on the photoreceptor, transferring the visible toner image onto the recording medium, and fusing the transferred visible toner image on the recording medium.

A process cartridge is an assembly of components for forming a visible toner image. The process cartridge is a consumable product that is detachable from a main body of an image forming apparatus and replaceable after a lifespan thereof has ended. A process cartridge may have various structures, such as a structure in which a photoreceptor, a development roller that supplies toner to the photoreceptor, and a container portion containing toner are integrally formed, a structure divided into an image cartridge including a photoreceptor and a development roller and a toner cartridge containing toner, or a structure divided into a photoreceptor cartridge including a photoreceptor, a development cartridge including a development roller, and a toner cartridge containing toner.

A cartridge includes a memory unit storing various types of information about the cartridge. When the cartridge is mounted in a main body of an image forming apparatus, the memory unit is electrically connected to the main body to communicate with the main body and may transmit information about the cartridge to the main body. The memory unit includes a contact portion that is electrically connected to a connection portion of the main body.

SUMMARY

One or more embodiments include a cartridge capable of preventing pollution of a contact portion of a memory unit included in the cartridge and an image forming apparatus using the cartridge.

One or more embodiments include a cartridge capable of preventing damage to a contact portion of a memory unit and an image forming apparatus using the cartridge.

One or more embodiments include a cartridge capable of preventing a connection error between a main body and the cartridge and an image forming apparatus using the cartridge.

Additional aspects will be set forth in part in the description which follows and, in part, will be apparent from the description, or may be learned by practice of the presented embodiments.

According to one or more embodiments, a cartridge being attached to or detached from a main body of an image forming apparatus which has an opening portion and a door that opens or closes the opening portion, includes: a memory unit that includes a contact portion via which the cartridge is connected to the main body to transmit information of the cartridge to the main body; and a moving member on which the contact portion is mounted, wherein the moving member is moved to a first position where the contact portion is hidden inside the cartridge and a second position where the contact portion protrudes out of the cartridge in order to be connected to a connection portion provided in the main body, wherein the moving member is moved to the second position in connection with a closing operation of the door.

An inclination guide portion that is inclined with respect to a moving direction of the moving member may be provided on the moving member, wherein when the door is closed, a push lever provided at the door pushes the inclination guide portion so as to move the moving member to the second position.

The cartridge may further include an elastic member that applies an elastic force to the moving member so that the moving member is located at the first position.

The cartridge may further include a handle that is pushed by a push lever provided at the door when the door is closed, the handle pivoting from a holding position protruding from the cartridge to a first accommodation position that is close to the cartridge, wherein the moving member is connected to the handle and is moved from the first position to the second position when the handle is pivoted from the holding position to the first accommodation position.

The cartridge may further include a conversion unit that converts pivoting movement of the handle to sliding movement of the moving member.

The cartridge may further include an accommodation portion that is dented such that the handle located at the first accommodation position is accommodated therein.

The handle may be slid from the holding position to a second accommodation position in the accommodation portion, wherein when the handle is disposed at the holding position and the first accommodation, a pivoting shaft of the handle is connected to the conversion unit, and wherein when the handle is located at the second accommodation position, the pivoting shaft of the handle is released from the conversion unit.

The moving member may return from the second position to the first position via an operation of opening the door.

The cartridge may further include: a first lever that is slid according to opening and closing operations of the door; and a second lever that is connected to the first lever and the moving member and is pivoted via sliding movement of the first lever so as to slide the moving member.

The first lever may include a first portion that is pushed by a push lever provided at the door when the door is closed and a second portion that is caught by a hook of a pull lever provided at the door when the door is opened.

The cartridge may further include: a first guide portion that allows the hook to escape from the first portion when the door is closed; and a second guide portion that allows the hook to escape from the second portion after the moving member is returned to the first position when the door is opened.

The cartridge may further include a connection unit that connects the second lever and the moving member such that the moving member slides on the same plane as a pivoting plane of the second lever.

The cartridge may further include a connection unit that connects the second lever and the moving member such that the moving member slides in a direction orthogonal to a pivoting plane of the second lever.

The cartridge may further include a protection member that is moved as the contact portion is moved to the first or second position to a retreat position that is hidden in the cartridge and a protruding position protruding out of the cartridge so that the protection member is inserted into an insertion portion provided in the main body.

The protection member is inserted into the insertion portion before the contact portion is connected to the connection portion so as to align the contact portion and the connection portion.

A front end portion of the protection member may be protruded more than a front end portion of the contact portion in a moving direction of the contact portion.

The contact portion may be moved in a length direction of the cartridge that is orthogonal to a mounting direction of the cartridge, wherein the protection member is disposed before the contact portion in the mounting direction of the cartridge.

The protection member may be integrally formed with the moving member.

The cartridge may further include a toner containing unit containing toner.

The cartridge may further include: a development roller; and a toner containing unit containing toner to be supplied to the development roller.

The cartridge may further include: a toner containing unit containing toner; a photoconductor on which an electrostatic latent image is formed; and a development roller that supplies the toner of the toner containing unit to the electrostatic latent image.

According to one or more embodiments, an image forming apparatus includes: a main body having an opening portion; a door that opens and closes the opening portion; and a cartridge of claim 1, wherein the cartridge is attached to or detached from the main body through the opening portion.

According to one or more embodiments, an image forming apparatus includes: a main body having an opening portion; a door that opens and closes the opening portion; and a cartridge that is attached to or detached from the main body through the opening portion, wherein the cartridge includes: a memory unit that includes a contact portion via which the cartridge is to be connected to the main body to transmit information of the cartridge to the main body; and a moving member on which the contact portion is mounted, wherein the moving member is moved to a first position where the contact portion is hidden inside the cartridge and a second position where the contact portion protrudes out of the cartridge in order for the contact portion to be connected to the connection portion, wherein the moving member is moved to the first position and the second position in connection with opening and closing operations of the door.

The cartridge may include a first lever that slides according to opening and closing operations of the door and a second lever that is connected to the moving member and is pivoted according to a sliding operation of the first lever so as to slide the moving member.

A push lever and a pull lever may be provided at the door, wherein the push lever pushes the first lever when the door is closed and the pull lever includes a hook that pulls the first lever when the door is opened.

The first lever may include a first portion that is pushed by the push lever when the door is closed and a second portion that is caught by the hook when the door is opened.

The cartridge may include a first guide portion that allows the hook to escape from the first portion when the door is closed and a second guide portion that allows the hook to escape from the second portion after the moving member is returned to the first position when the door is opened.

The pull lever may include an elastic arm that is elastically pivoted by interfering with the first and second guide portions.

The pull lever may include a pivoting arm that is pivotably installed with respect to a pivot shaft provided at the door and is pivoted by interfering with the first and second guide portions.

The hook may include an interference portion that interferes with the second guide portion, a non-interference portion that does not interfere with the second guide portion, and a puling portion that is provided in the non-interference portion and is hooked on the second portion of the first lever when the door is opened.

The cartridge may include a connection unit that connects the second lever and the moving member such that the moving member slides within the same plane as a pivoting plane of the second lever.

The cartridge may include a connection unit that connects the second lever and the moving member such that the moving member slides in a direction orthogonal to a pivoting plane of the second lever.

According to one or more embodiments a cartridge includes a memory unit having a contact portion electrically connectable to a connector of a main body of an image forming apparatus to transmit information of the cartridge to the main body, and a moving member apparatus extending the contact portion outside the cartridge into the connector when a door of the main body is closed. The moving member may include an inclined plane attached to the contact portion and a push lever that contacts the plane and forces the plane toward the connector when the door is closed. The inclined plane may include a guide grove and the moving member is bi-directionally moved by a guide post sliding in the guide groove. The moving member may include a rack gear attached to the contact portion, a pinion gear attached to the rack gear and a push lever attached to the pinion gear. The lever may be coupled to a cartridge user handle used in inserting the cartridge into the main body and the lever is operated by the handle. The moving member may include a rack gear attached to the contact portion, a spur gear attached to the rack gear, a bevel gear attached to the spur gear, a pinion gear attached to the spur gear and a cartridge user handle used in inserting the cartridge into the main body and attached to the pinion gear. The moving member may include a first slide attached to contact portion, a lever slidably engaged with first slide and a second slide slidably engaged with the lever and operated by motion of a door of the main body. The moving member may include a first slide attached to contact portion, a lever engaged with first slide via a cam moving in an arc shaped slot and a second slide slidably engaged with the lever and operated by motion of a door of the main body.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
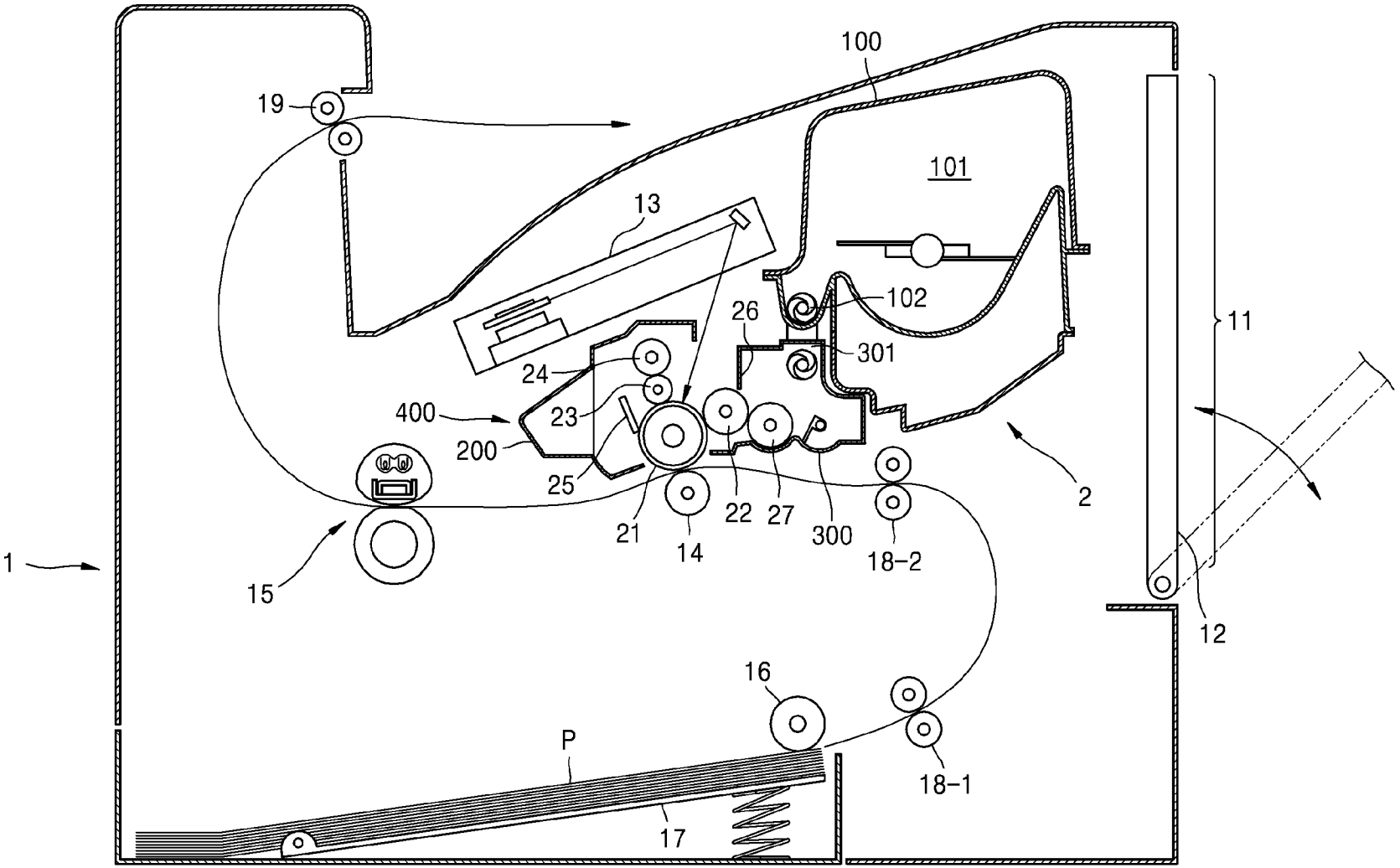
FIG. 1 is a schematic structural diagram of an electrophotographic image forming apparatus according to an embodiment of the present general concept.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

FIG. 1 is a schematic structural diagram of an electrophotographic image forming apparatus according to an embodiment.

Referring to FIG. 1, a main body 1 of the image forming apparatus and a process cartridge 2 are shown. The main body 1 includes an opening 11 providing a passage for the process cartridge 2 to be mounted in or removed from the main body 1. A door 12 closes or opens the opening 11. The main body 1 includes an exposure unit 13, a transfer roller 14, and a fusing unit 15. Also, the main body 1 includes a recording medium transfer structure for loading and transferring a recording medium P where an image is to be formed.

The process cartridge 2 may include a toner containing unit 101, a photoconductive drum 21, on a surface of which an electrostatic latent image is formed, and a development roller 22 that receives toner from the toner containing unit 101 to supply the toner to the electrostatic latent image so as to develop the electrostatic latent image into a visible toner image.

The photoconductive drum 21 is an example of a photoreceptor, an electrostatic latent image being formed on a surface thereof, and may include a conductive metal pipe and a photosensitive layer around the conductive metal pipe. A charging roller 23 is an example of a charger for charging the photoconductive drum 21 to have a uniform surface potential. A charging brush or a corona charger may be used instead of the charging roller 23. A reference numeral 24 denotes a cleaning roller for removing foreign materials on a surface of the charging roller 23. A cleaning blade 25 is an example of a cleaning unit for removing toner and foreign materials on a surface of the photoconductive drum 21 after a transfer process which will be described later. A cleaning apparatus having another shape, such as a rotating brush, may be used instead of the cleaning blade 25.

Figure 2A:
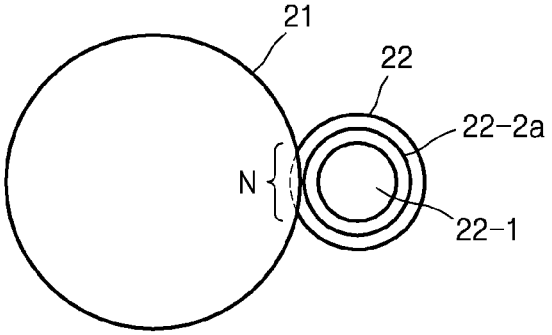
FIG. 2A is a diagram of an arrangement of a photoconductive drum and a development roller according to a contact development method.
Figure 2B:
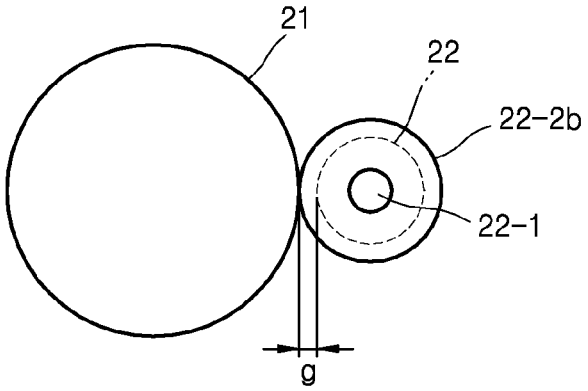
FIG. 2B is a diagram of an arrangement of a photoconductive drum and a development roller according to a non-contact development method.

Examples of a development method include a one-component development method in which toner is used and a two-component development method in which toner and a carrier are used. The process cartridge 2 according to the current embodiment uses a one-component development method. The development roller 22 is used to supply toner to the photosensitive drum 21. A development bias voltage to supply toner to the photosensitive drum 21 may be applied to the development roller 22. The one-component development method may be classified into a contact development method, wherein the development roller 22 and the photoconductive drum 21 are rotated while contacting each other, and a non-contact development method, wherein the development roller 22 and the photoconductive drum 21 are rotated by being spaced apart from each other by dozens to hundreds of microns. FIG. 2A is a diagram of an arrangement of the photoconductive drum 21 and the development roller 22 in the contact development method, and FIG. 2B is a diagram of an arrangement of the photoconductive drum 21 and the development roller 22 in the non-contact development method. Referring to FIG. 2A, in the contact development method, a gap maintaining member 22-2*a* having a smaller diameter than the development roller 22 may be provided on each of both ends of a rotation shaft 22-1 of the development roller 22. A contact amount of the development roller 22 to the photoconductive drum 21 is constrained by the gap maintaining member 22-2*a* which contacts the surface of the photoconductive drum 21. A development nip N is formed as the development roller 22 contacts the photoconductive drum 21. Referring to FIG. 2B, in the non-contact development method, a gap maintaining member 22-2*b* having a larger diameter than the development roller 22 may be provided on each of the both ends of the rotation shaft 22-1 of the development roller 22. A development gap g between the development roller 22 and the photoconductive drum 21 is constrained by the gap maintaining member 22-2*b* which contacts the surface of the photoconductive drum 21.

A regulator 26 (FIG. 1) constrains an amount of toner supplied from the development roller 22 to a development region where the photoconductive drum 21 and the development roller 22 face each other. The regulator 26 may be a doctor blade elastically contacting a surface of the development roller 22. A supply roller 27 supplies toner in the process cartridge 2 to a surface of the development roller 22. To this end, a supply bias voltage may be applied to the supply roller 27.

When a two-component development method is used, the development roller 22 is spaced apart from the photoconductive drum 21 by dozens to hundreds of microns. Although not illustrated in the drawings, the development roller 22 may have a structure in which a magnetic roller is disposed in a hollow cylindrical sleeve. The toner is adhered to a surface of a magnetic carrier. The magnetic carrier is adhered to the surface of the development roller 22 to be transferred to the development region where the photoconductive drum 21 and the development roller 22 face each other. Only the toner is supplied to the photoconductive drum 21 according to the development bias voltage applied between the development roller 22 and the photoconductive drum 21, and thus the electrostatic latent image formed on the surface of the photoconductive drum 21 is developed into the visible toner image. The process cartridge 2 may include an agitator (not shown) for mixing and stirring the toner and a carrier and transporting the mixture to the development roller 22. The agitator may be an auger, and a plurality of the agitators may be prepared in the process cartridge 2.

The exposure unit 13 forms the electrostatic latent image on the photoconductive drum 21 by irradiating light modulated according to image information to the photoconductive drum 21. The exposure unit 13 may be a laser scanning unit (LSU) using a laser diode as a light source, or a light-emitting diode (LED) exposure unit using an LED as a light source.

The transfer roller 14 is an example of a transfer unit for transferring a toner image from the photoconductive drum 21 to the recording medium P. A transfer bias voltage for transferring the toner image to the recording medium P is applied to the transfer roller 14. A corona transfer unit or a transfer unit using a pin scorotron method may be used instead of the transfer roller 14.

The recording media P (FIG. 1) are picked up one by one from a loading table 17 by a pickup roller 16, and are transferred by feed rollers 18-1 and 18-2 to a region where the photoconductive drum 21 and the transfer roller 14 face each other.

The fusing unit 15 applies heat and pressure to an image transferred to the recording medium P so as to fuse the image on the recording medium P. The recording medium P that passed through the fusing unit 15 is discharged outside the main body 1 by a discharge roller 19.

According to the above structure, the exposure unit 13 irradiates the light modulated according to the image information to the photoconductive drum 21 to develop the electrostatic latent image. The development roller 22 supplies the toner to the electrostatic latent image to form the visible toner image on the surface of the photoconductive drum 21. The recording medium P loaded in the loading table 17 is transferred to the region where the photoconductive drum 21 and the transfer roller 14 face each other by the pickup roller 16 and the feed rollers 18-1 and 18-2, and the toner image is transferred on the recording medium P from the photoconductive drum 21 according to the transfer bias voltage applied to the transfer roller 14. After the recording medium P passes through the fusing unit 15, the toner image is fused on the recording medium P according to heat and pressure. After the fusing, the recording medium P is discharged by the discharge roller 19.

The process cartridge 2 (FIG. 1) may have a first structure divided into an imaging cartridge 400 including the photoconductive drum 21 and the development roller 22 and a toner cartridge 100 including the toner containing unit 101, a second structure divided into a photoreceptor cartridge 200 including the photoconductive drum 21, a development cartridge 300 including the development roller 22, and a toner cartridge 100 including the toner containing unit 101, a third structure divided into a photoreceptor cartridge 200 and a development cartridge 300 including the toner containing unit 101, or a fourth structure in which a photoreceptor cartridge 200, a development cartridge 300, and a toner cartridge 100 are integrally formed with one another.

In the process cartridge 2 having the first structure (or the second structure), when the toner cartridge 100 is mounted in the main body 1, the toner cartridge 100 is connected to the imaging cartridge 400 (or the development cartridge 300). For example, when the toner cartridge 100 is mounted in the main body 1, a toner discharging unit 102 of the toner cartridge 100 and a toner inlet portion 301 of the imaging cartridge 400 (or the development cartridge 300) are connected to each other.

Figure 3A:
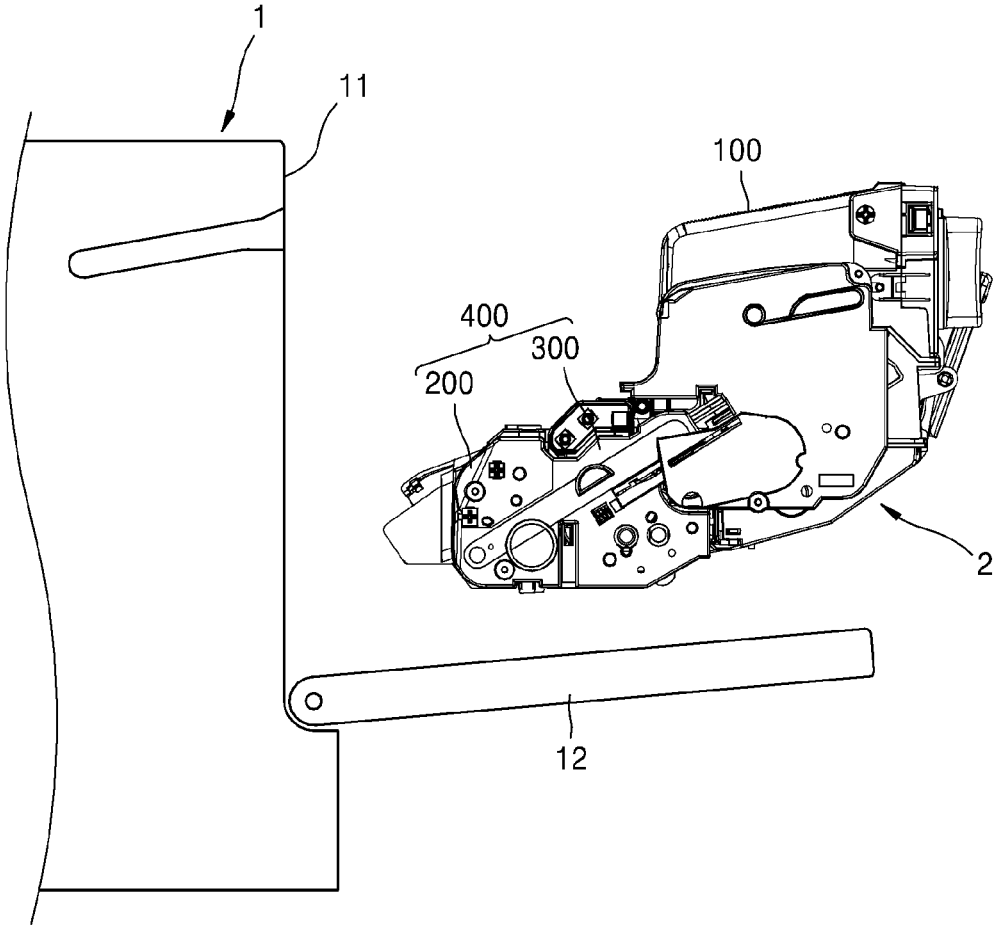
FIG. 3A illustrates replacement of a process cartridge.
Figure 3B:
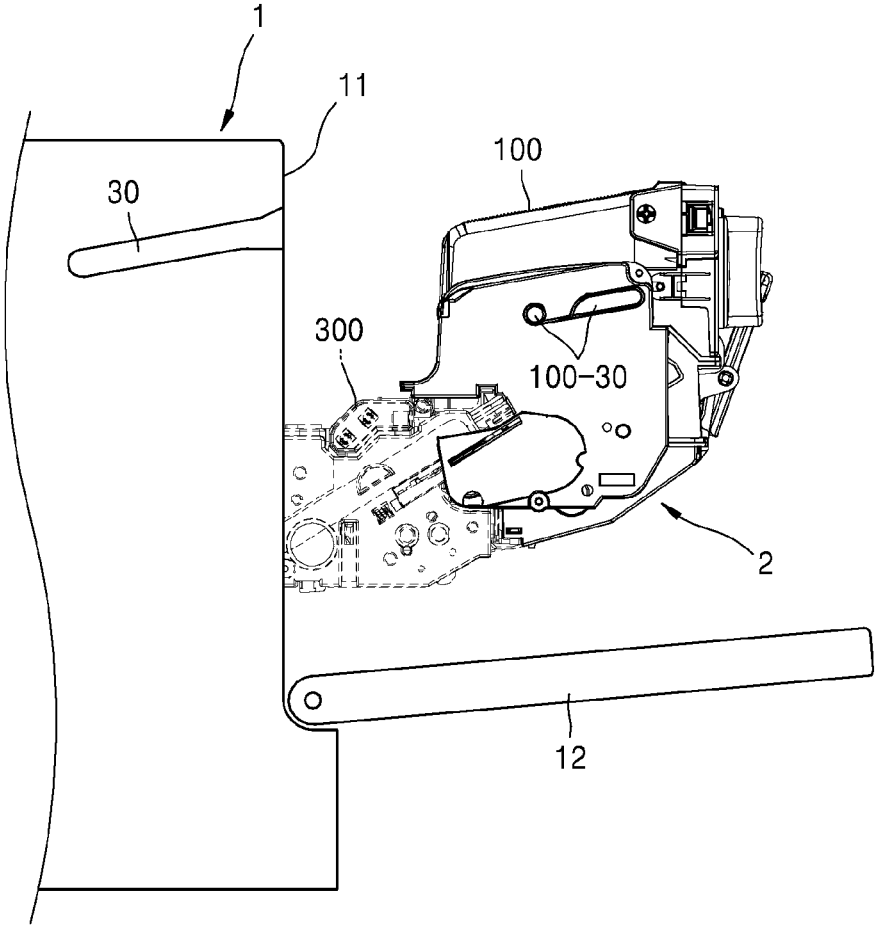
FIG. 3B illustrates replacement of a toner cartridge.

The process cartridge 2 is a consumable product that is replaced after its lifespan expires. The process cartridge 2 is attached to or detached from the main body 1 via the opening portion 11. In the case of the process cartridge 2 having the fourth structure, when toner contained in the toner containing unit 101 is consumed completely, the process cartridge 2 as a whole is replaced as illustrated in FIG. 3A. In general, the lifespan of the imaging cartridge 400 is longer than the lifespan of the toner cartridge 100. By using the process cartridge 2 having the first structure, the second structure or the third structure, the toner cartridge 100 or the development cartridge 300 in which the toner containing unit 101 is integrally formed may be individually replaced as illustrated in FIG. 3B, and thus, costs for replacement of consumables may be reduced. The process cartridge 2 according to the current embodiment has the first structure. Referring to FIG. 3B, a guide rail 30 that guides the toner cartridge 100 is included in the main body 1, and a guide protrusion 100-30 that is inserted into the guide rail 30 may be formed on the toner cartridge 100.

Figure 4:
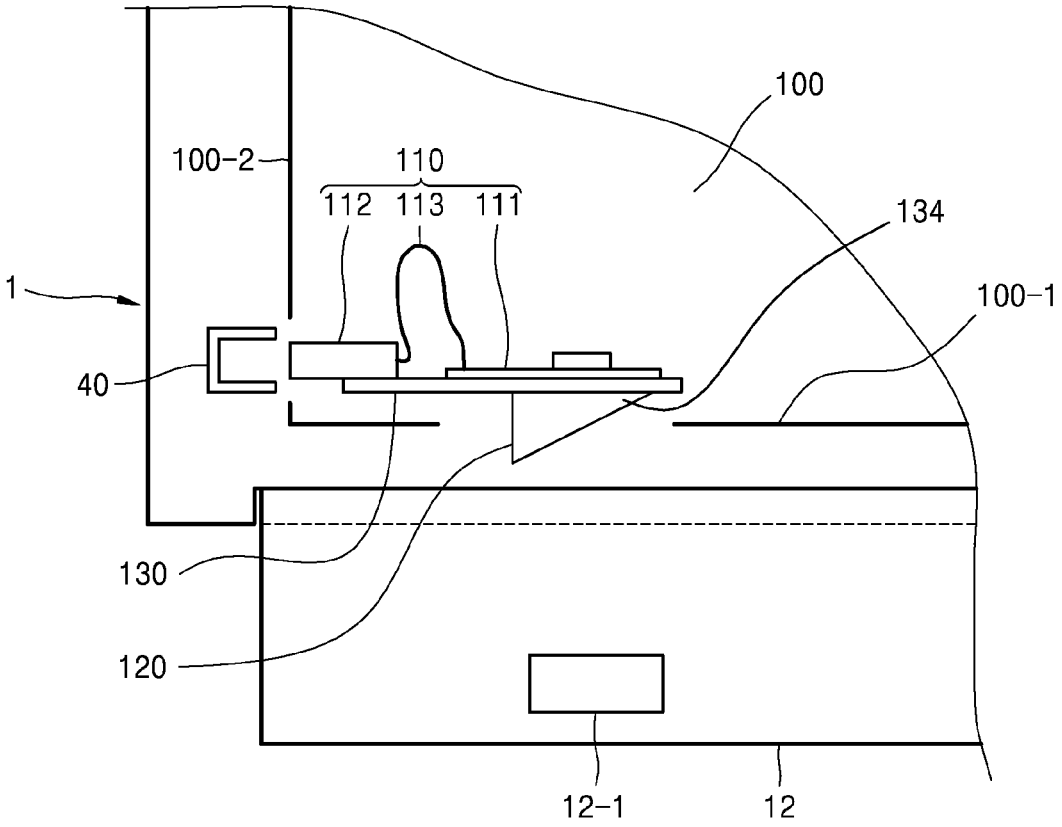
FIGS. 4 and 5 are plan views of an image forming apparatus according to an embodiment, illustrating a connection structure between a memory unit and a main body.
Figure 5:
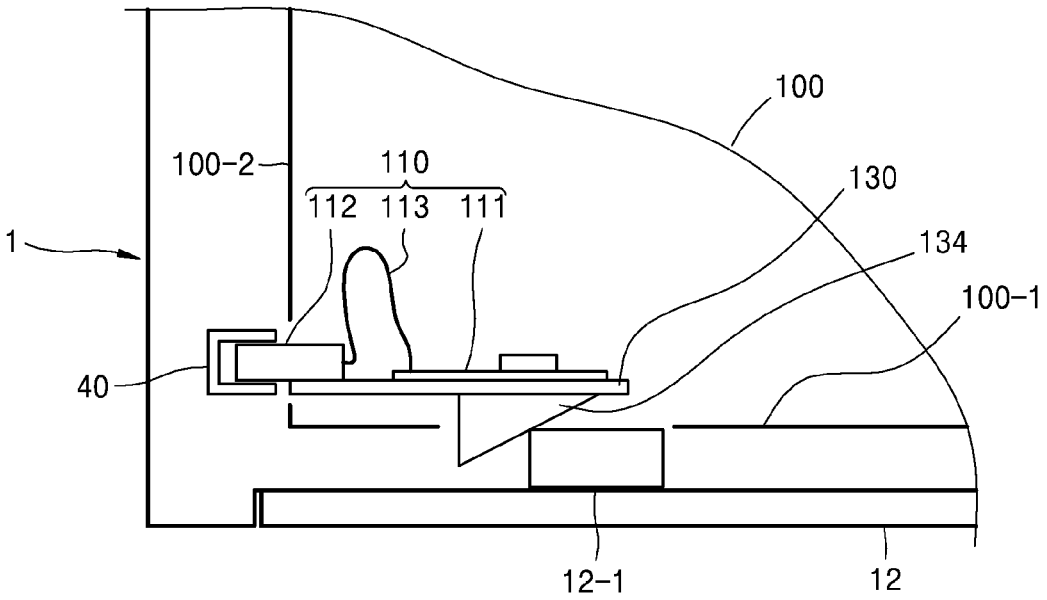

FIGS. 4 and 5 are partial plan views of the image forming apparatus according to an embodiment. FIG. 4 illustrates the door 12 in an opened state, and FIG. 5 illustrates the door 12 in a closed state. Referring to FIGS. 4 and 5, the memory unit 110 is included in the toner cartridge 100. When the toner cartridge 100 is mounted in the main body 1, the memory unit 110 is electrically connected to the main body 1 to transmit information of the toner cartridge 100 to the main body 1. The main body 1 may determine whether the toner cartridge 100 is mounted by determining whether the memory unit 110 is electrically connected to the main body 1, for example, by determining whether communication with the memory unit 110 is possible or not.

The memory unit 110 may include a circuit unit 111 to monitor or manage a state of the toner cartridge 100 and a contact portion 112 via which the memory unit 110 is connected to the main body 1. The circuit unit 111 may include a customer replaceable unit monitor unit (CRUM) including a central processing unit (CPU) that performs at least one of authentication and/or coding of data communication with respect to the main body 1 by using, for example, an operating system (OS) included in the circuit unit 111. The circuit unit 111 may further include a memory. The memory may store various types of information about the toner cartridge 100, for example, manufacturer information, manufacture date information, a serial number, or a model number, various programs, electronic signature information, and usage state (for example, a number of pages printed so far, a number of remaining printable pages, or an amount of toner left). Also, the memory may store the lifetime or setup menus of the toner cartridge 100. In addition, the circuit unit 111 may include a functional block capable of performing various functions for communication, authentication, or coding. The circuit unit 111 may be in the form of a chip including a CPU, a chip including a memory and a CPU, or a printed circuit board on which chips and circuit elements for implementing various functional blocks are mounted.

The contact portion 112 may be integrally formed with the printed circuit board of the circuit unit 111, or may be connected to the circuit unit 111 via a signal line 113. The contact portion 112 may be, for example, a modular jack. A connection portion 40 that is connected to the contact portion 112 is included in the main body 1. The connection portion 40 may be in the form of a modular connector into which the contact portion 112 in the form of a modular jack is inserted. Also, the contact portion 112 may be in the form of a conductive pattern. The contact portion 112 in the form of a conductive pattern may be formed on a circuit board which is not shown, or may be integrally formed with a printed circuit board of the circuit unit 111. The memory unit 110 is in the form of a package in which the circuit unit 111 is included and from which the contact portion 112 is exposed to the outside, and the contact portion 112 may be in the form of a conductive pattern and may be exposed out of the package. In this case, the connection portion 40 may include a pin type terminal that is electrically connectable to the contact portion 112 which is in the form of a conductive pattern. Also, the contact portion 112 may be a pin type terminal, and the connection portion 40 may be in the form of a conductive pattern to which the pin type terminal is connected. Alternatively, the contact portion 112 and the connection portion 40 may have various forms whereby they may be electrically connected to each other.

While the toner cartridge 100 is separated from the main body 1, when the contact portion 112 is protruded out of the toner cartridge 110 as illustrated in FIG. 5, the contact portion 112 may be polluted or damaged when handling the toner cartridge 100. Also, when mounting the toner cartridge 100 in the main body 1, the contact portion 112 may be damaged due to collision with the main body 1. Damage to or pollution of the contact portion 112 may be the cause of a contact defect between the contact portion 112 and the connection portion 40.

To solve this problem, the memory unit 110 includes the contact portion 112 that is movable to a first position (FIG. 4) that is hidden inside the toner cartridge 100 and a second position (FIG. 5) that is protruded from the toner cartridge 100. For example, the contact portion 112 may be mounted on a moving member 130 and be moved to the first and second positions. After the toner cartridge 100 is mounted in the main body 1, the contact portion 112 is moved to the second position where the contact portion 112 is electrically connected to the connection portion 40 included in the main body 1, and before the toner cartridge 100 is detached from the main body 1, the contact portion 112 is moved to the second position where an electrical connection between the contact portion 112 and the connection portion 40 is terminated. A protruding direction of the contact portion 112 at the second position is not limited. The contact portion 112 may be protruded in various directions, for example, to a side portion 100-2, an upper portion, a lower portion, a front portion, or a rear portion 100-1 of the toner cartridge 100.

Hereinafter, an embodiment will be described in which the contact portion 112 is moved in a length direction of the toner cartridge 100 that is orthogonal to a mounting direction A, so as to be protruded to the side portion 100-2 of the toner cartridge 100.

After the toner cartridge 100 is mounted in the main body 1, the contact portion 112 may be moved from the first position to the second position via an operation of closing the door 12. For example, when the door 12 is closed, the moving member 130 may be pushed via a push lever 12-1 provided at the door 12 so as to be moved from the first position to the second position.

Figure 6:
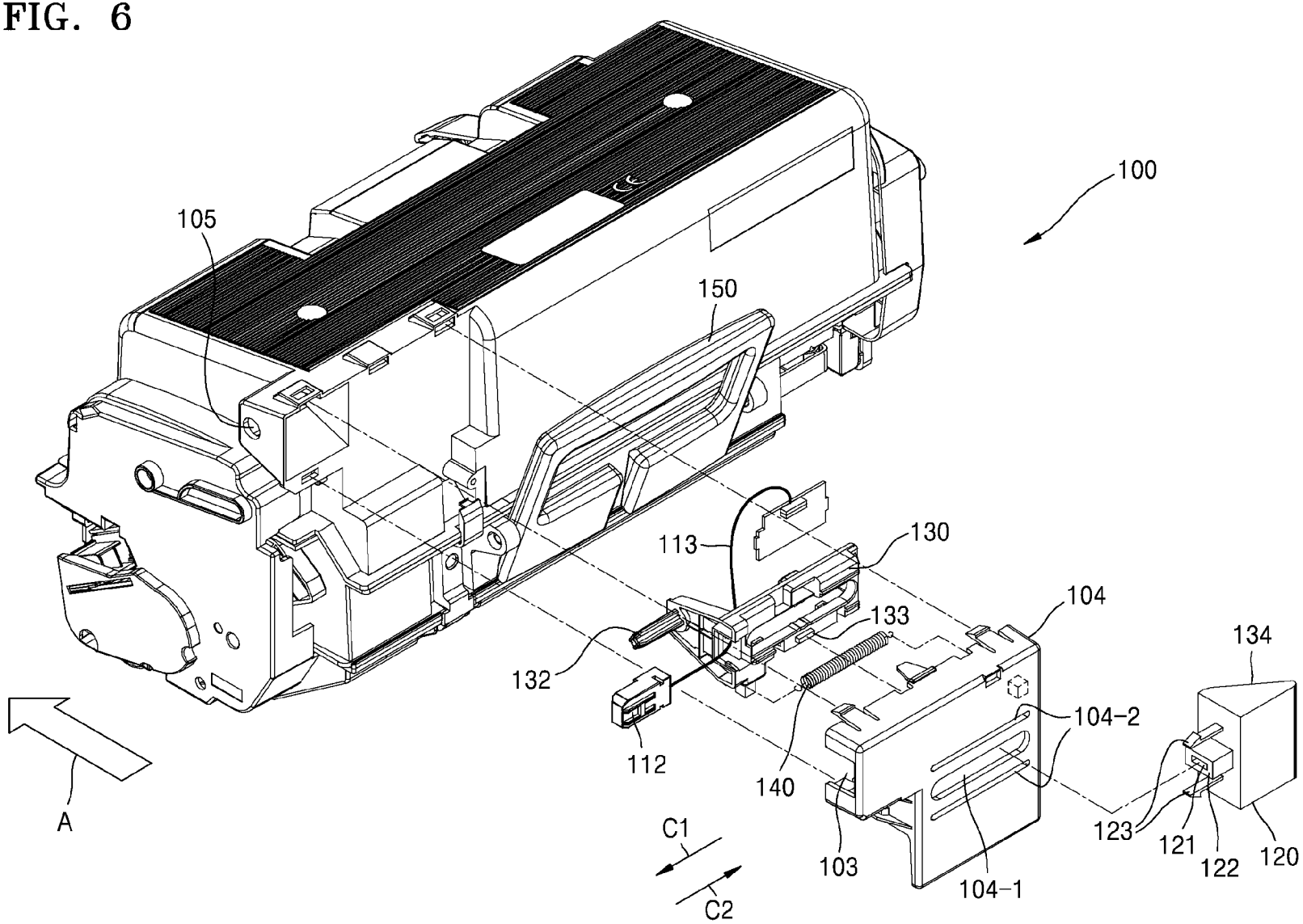
FIG. 6 is an exploded perspective view of a toner cartridge according to an embodiment.
Figure 7A:
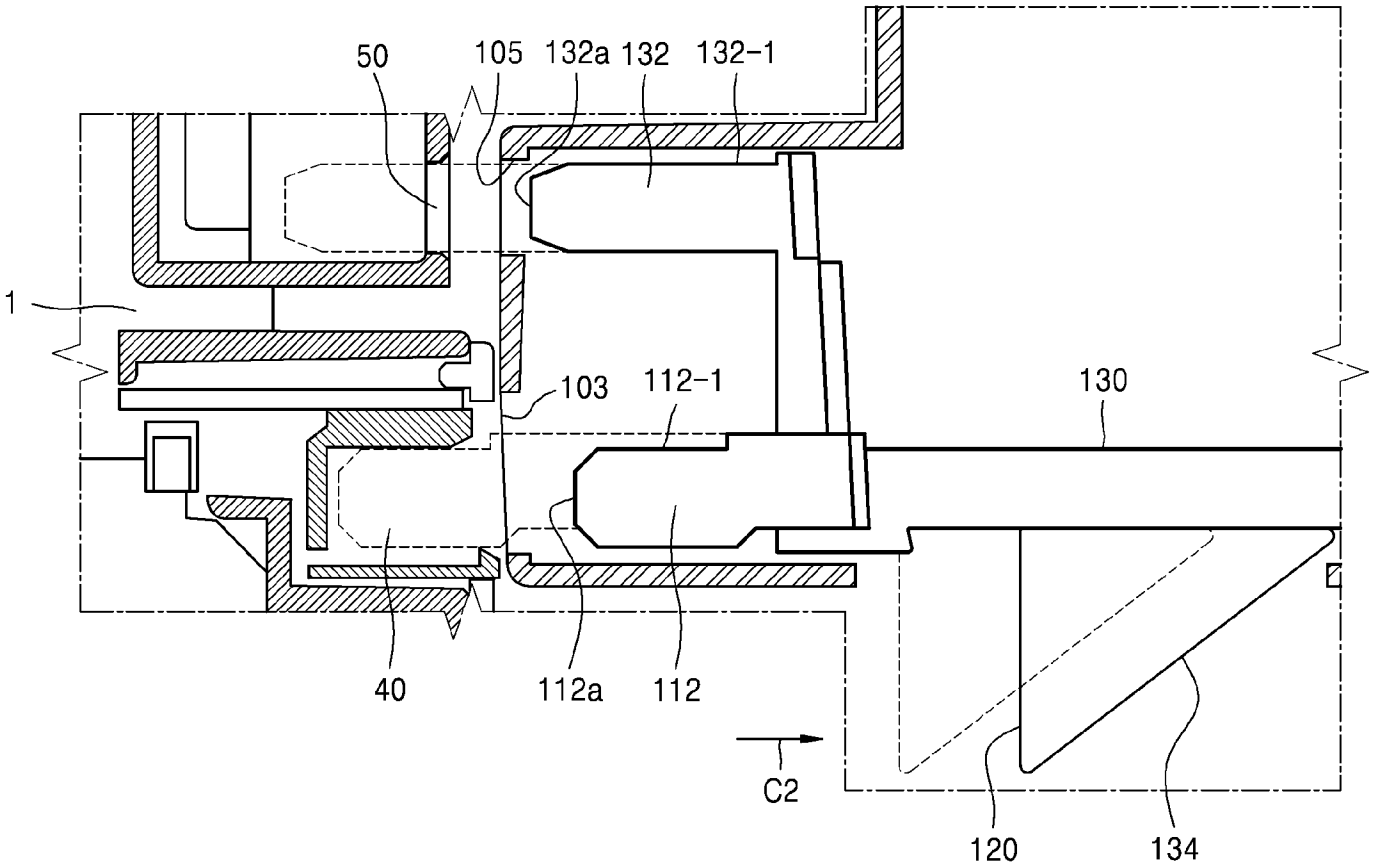
FIG. 7A is a plan view illustrating the toner cartridge illustrated in FIG. 6 mounted in the main body, wherein a contact portion and a protection member are respectively located at a first position and a retreat position.
Figure 7B:
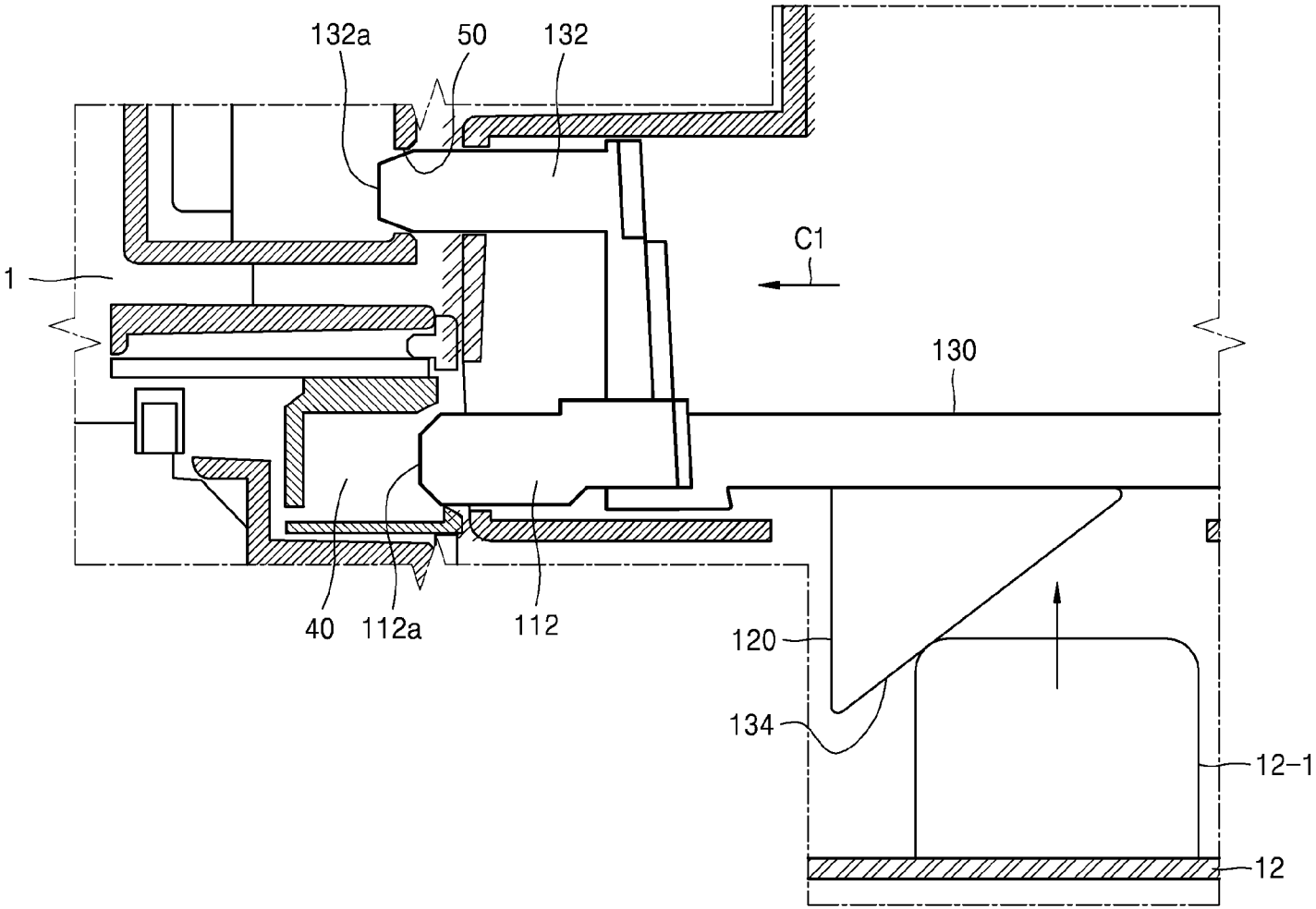
FIG. 7B is a plan view illustrating the toner cartridge illustrated in FIG. 6 mounted in the main body, wherein a contact portion and a protection member are respectively moved to a second position and a protruding position.
Figure 7C:
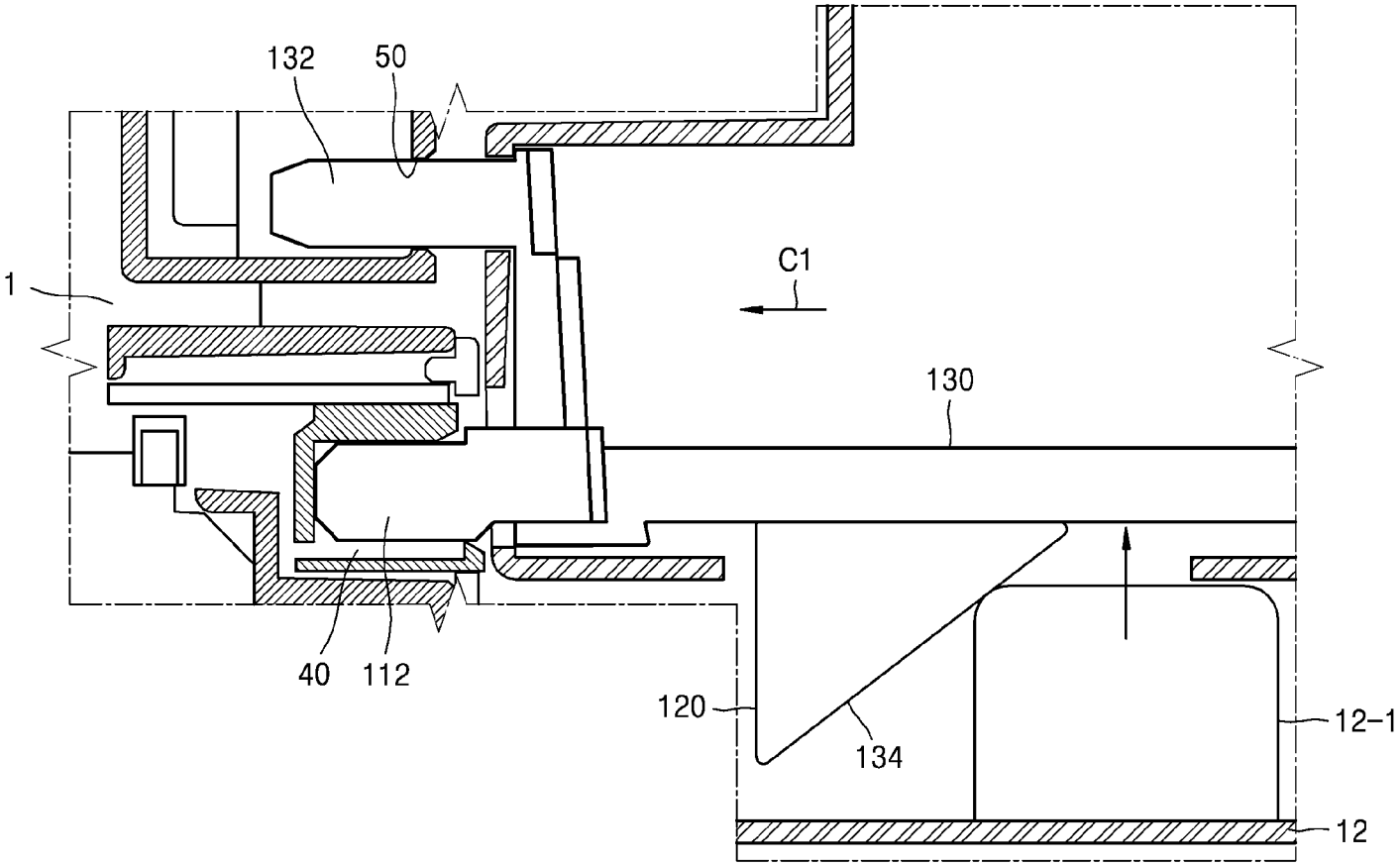
FIG. 7C is a plan view illustrating the toner cartridge illustrated in FIG. 6 mounted in the main body, wherein a contact portion and a protection member are respectively located at a second position and a protruding position.

FIG. 6 is an exploded perspective view of the toner cartridge 100 according to an embodiment. FIG. 7A is a plan view illustrating the toner cartridge 100 illustrated in FIG. 6 mounted in the main body 1, wherein the contact portion 112 is located at the first position. FIG. 7B is a plan view illustrating the toner cartridge 100 illustrated in FIG. 6 mounted in the main body, wherein the contact portion 112 is moved to the second position. FIG. 7C is a plan view illustrating the toner cartridge 100 illustrated in FIG. 6 mounted in the main body 1, wherein the contact portion 112 is located at the second position.

Referring to FIGS. 6, and 7A through 7C, the moving member 130 is installed on the toner cartridge 100. For example, the moving member 130 may be slidably installed in an inner portion of the rear cover 104 that is coupled to the rear portion 100-1 of the toner cartridge 100, in a length direction that is orthogonal to the mounting direction A, that is, in directions C1 and C2. The contact portion 112 may be fixed to the moving member 130 and may be connected to the circuit unit 111 via the signal line 113.

When the door 12 is closed, the moving member 130 is pulled by the push lever 12-1 provided at the door 12 so that the contact portion 112 is slid in the direction C1 to be located at the second position. The push lever 12-1 may be protruded from an inner surface of the door 12. An inclination guide portion 134 (or included plane) that contacts the push lever 12-1 as the door 12 is closed is provided at the moving member 130. The inclination guide portion 134 is inclined with respect to a sliding direction of the moving member 130, that is, in a moving direction of the contact portion 112.

According to the current embodiment, the moving member 130 includes a knob 120. The inclination guide portion 134 is provided on the knob 120. The knob 120 is located at a position facing the opening portion 11 when the toner cartridge 100 is mounted to the main body 1 so that a user may easily access the knob 120 via the opening portion 11 that is opened via the door 12 when the toner cartridge 100 is attached to or detached from the main body 1. For example, the knob 120 may be located at the rear portion 100-1 of the toner cartridge 100 with respect to the mounting direction A of the toner cartridge 100. A handle 150 may be provided at the toner cartridge 100 to be held by the user in an attaching or detaching operation, and the knob 120 may be disposed adjacent to the handle 150. Accordingly, when the user attaches or detaches the toner cartridge 100, the user may easily recognize and manipulate the knob 120.

The knob 120 may be integrally formed with the moving member 130 or may be an additional member as illustrated in FIG. 6 that is coupled to the moving member 130. A coupling piece 133 protruding toward the rear cover 104 is provided on the moving member 130. The knob 120-1 includes a coupling portion 122 in which a groove 121 is formed. Slots 104-1 and 104-2 are formed by cutting in the rear cover 104 such that the knob 120 coupled to the moving member 130 may slide therein. The coupling portion 122 is inserted into the slot 104-1 from the outside of the rear cover 104, and the coupling piece 133 is coupled to the groove 121 of the coupling portion 122. Also, a fixing hook 123, provided on the knob 120, is inserted into the slot 104-2. According to the above structure, as the user slides the knob 120 that is exposed at the rear portion 100-1 of the toner cartridge 100 along the slots 104-1 and 104-2, the contact portion 112 may be moved to the first and second positions.

Hereinafter, an operation of mounting the toner cartridge 100 in the main body 1 will be described with reference to FIGS. 6 and 7A through 7C.

The toner cartridge 100 is mounted in the main body 1 while the contact portion 112 is located at the first position. If the toner cartridge 100 is mounted in the main body 1 while the contact portion 112 is located at the second position, the contact portion 112 may collide with the main body 1 or the connection portion 40, and the contact portion 112 may be damaged. Thus, before mounting the toner cartridge 100 in the main body 1, the moving member 130 is slid in the direction C2 by using the knob 120 to thereby locate the contact portion 112 at the first position as illustrated in FIG. 7A. In this state, the door 12 is opened to mount the toner cartridge 100 in the main body 1 through the opening 11.

Then, when the door 12 is closed, the push lever 12-1 pushes the inclination guide portion 134 as illustrated in FIG. 7B, and consequently, the moving member 130 starts to slide in the direction C1. The contact portion 112 protrudes from the side portion 100-2 of the toner cartridge 100 and starts to be inserted into the connection portion 40 provided in the main body 1.

When the door 12 is completely closed, the contact portion 112 reaches the second position where it is completely inserted into the connection portion 40 as illustrated in FIG. 7C.

To detach the toner cartridge 100 from the main body 1, first, the door 12 is opened to open the opening portion 11. The contact portion 112 is disposed at the second position as illustrated in FIG. 7A by a dotted line. As the contact portion 112 is inserted into the connection portion 40, if the toner cartridge 100 is detached from the main body 1 in this state, the contact portion 112 or the connection portion 40 may be damaged. Accordingly, before detaching the toner cartridge 100, the knob 120 is slid in the direction C2 to thereby return the contact portion 112 to the first position as illustrated in FIG. 7A by a solid line. Then the toner cartridge 100 is detached from the main body 1.

After the toner cartridge 100 is mounted in the main body 1, the contact portion 112 is moved to the second position so that the memory unit 110 is connected to the main body 1, and if the contact portion 112 is not converted into the second position, the toner cartridge 100 and the main body 1 are not connected to each other. According to the above-described embodiment, after the user mounts the toner cartridge 100 in the main body 1 and as the contact portion 112 is moved to the second position via an operation of closing the door 12, no connection error between the toner cartridge 100 and the main body 1 is caused, and the user does not have to move the contact portion 112 to the second position.

If the toner cartridge 100 is mounted to or detached from the main body 1 while the contact portion 112 is disposed at the second position, the contact portion 112 and/or the connection portion 40 may be damaged. Referring to FIG. 6 again, a protection member 132 that prevents a collision between the contact portion 112 and the main body 1 or the connection portion 40 is illustrated. The protection member 132 is moved together with the contact portion 112. That is, the protection member 132 has a retreat position which is hidden inside the toner cartridge 100 and a protruding position protruding from the toner cartridge 100. For example, the protection member 132 may be integrally formed with the moving member 130. According to the above structure, when the contact portion 112 is located at the first position as illustrated in FIG. 7A by a solid line, the protection member 132 is located at the retreat position which is accommodated in the toner cartridge 100. When the contact portion 112 is located at the second position as illustrated in FIG. 7A by a dotted line, the protection member 132 is located at the protruding position protruding from the side portion 100-2 of the toner cartridge 100 via a second exit 105.

Referring to FIGS. 6 and 7A, with respect to the mounting direction A, the protection member 132 is located before the contact portion 112. That is, a forefront surface 132-1 of the protection member 132 in the mounting direction A is located before a forefront surface 112-1 of the contact portion 112 in the mounting direction A. According to the above structure, when the contact portion 112 is located at the second position, the protection member 132 is located at the protruding position. When mounting the toner cartridge 100 in the main body 1 while the contact portion 112 is located at the second position, the protection member 132 first contacts the main body 1 or the connection portion 40 before the contact portion 112 contacts the main body 1 or the connection portion 40. Accordingly, a collision between the contact portion 112 and the main body 1 or the connection portion 40 during a mounting operation may be prevented.

The toner cartridge 100 is mounted in the main body 1 as illustrated in FIG. 7A while the contact portion 112 and the protection member 132 are respectively located at the first position and the retreat position. An insertion portion 50 into which the protection member 132 is inserted is provided in the main body 1. Referring to FIG. 7A, the protection member 132 protrudes further than the contact portion 112 in a direction toward the protruding position. That is, a front end portion 132*a* of the protection member 132 protrudes further than the front end portion 112*a* of the contact portion 112 in the protruding direction. Although not shown in the drawing, the insertion portion 50 may be closer to the side portion 100-2 of the toner cartridge 100 than the connection portion 40.

When the door 12 is closed in this state, the moving member 130 is slid via the push lever 12-1, and the contact portion 112 and the protection member 132 are respectively slid together to the second position and the protruding position in the direction C1. While the contact portion 112 and the connection portion 40 are not completely aligned, that is, while the toner cartridge 100 is not completely inserted, if the contact portion 112 is inserted into the connection portion 40, the contact portion 112 may collide with the connection portion 40 and be damaged. According to the current embodiment, the protection member 132 may be inserted into the insertion portion 50 before the contact portion 112 is inserted into the connection portion 40 as illustrated in FIG. 7B, thereby aligning the contact portion 112 and the connection portion 40. Consequently, a possibility of damaging the contact portion 112 during insertion into the connection portion 40 may be reduced. When the door 12 is completely closed, the contact portion 112 is located at the second position where it is inserted into the connection portion 40, as illustrated in FIG. 7C, and the protection member 132 is located at the protruding position where it is inserted into the insertion portion 50.

When the toner cartridge 100 is to be detached from the main body 1 in a state as illustrated in FIG. 7C, as the contact portion 112 is inserted into the connection portion 40, a force may be applied to the contact portion 112. According to the current embodiment, as the protection member 132 is also inserted into the insertion portion 50, the force applied to the contact portion 112 is dispersed via the protection member 132. Accordingly, a possibility of damaging the contact portion 112 may be reduced.

As described above, as the protection member 132 is included, a possibility of damaging the contact portion 112 during a mounting or detaching operation of the toner cartridge 100 may be reduced.

Alternatively, a structure may also be provided in which the contact portion 112 is moved from the first position to the second position in connection with a closing operation of the door 12 and returns from the second position to the first position when the door 12 is opened. For example, referring back to FIG. 6, the toner cartridge 100 may further include an elastic member 140 that applies an elastic force to the moving member 130 to slide the moving member 130 in a direction in which the contact portion 112 is to be located at the first position. The elastic member 140 may be, for example, a tensile coil spring having a first end connected to the moving member 130 and a second end connected to the rear cover 104.

As described above, if the toner cartridge 100 is mounted to or detached from the main body 1 while the contact portion 112 is disposed at the second position, the contact portion 112 and/or the connection portion 40 are likely to be damaged. However, according to the toner cartridge 100 including the elastic member 140, the contact portion 112 is always disposed at the first position while the toner cartridge 100 is not mounted in the main body 1, and thus, a possibility of damage to the contact portion 112 and/or the connection portion 40 may be reduced when mounting or handling the toner cartridge 100. Also, when the door 12 is opened to detach the toner cartridge 100 from the main body 1, the contact portion 112 is released from the connection portion 40 and is moved to the first position, and thus, a possibility of damage to the contact portion 112 and/or the connection portion 40 during a detaching operation may be reduced.

When the elastic member 140 is included in the toner cartridge 100, the protection member 132 may not be included. When the protection member 132 is included, the protection member 132 may be disposed at a front portion or a rear portion of the contact portion 112 with respect to the mounting direction A. In this case, the front end portion 132*a* of the protection member 132 protrudes further than the front end portion 112*a* of the contact portion 112 in a moving direction thereof. While not shown in the drawings, the insertion portion 50 may be disposed closer to the side portion 100-2 of the toner cartridge 100 than the connection portion 40. According to the above structure, as described above, the contact portion 112 and the connection portion 40 are aligned by inserting the protection member 132 into the insertion portion 50 before the contact portion 112 is inserted into the connection portion 40, thereby reducing a possibility of damage to the contact portion 112 during insertion of the contact portion 112 into the connection portion 40.

Figure 8:
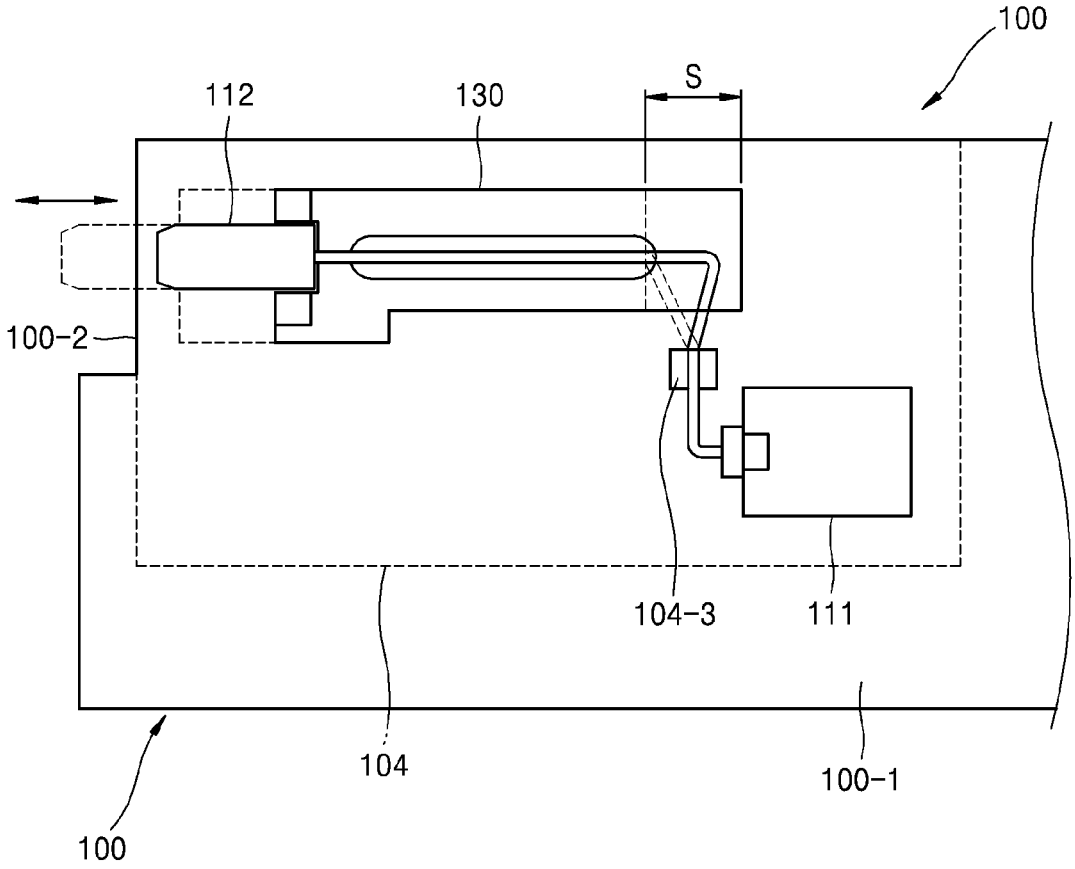
FIG. 8 is a rear view of a toner cartridge having a structure in which a circuit unit of a memory unit is located at a fixed position and a contact portion is moved to a first or second position, according to an embodiment.

According to the above-described embodiment, the circuit unit 111 is mounted on the moving member 130 and is moved with the contact portion 112 together. According to the above structure, while the contact portion 112 is moved to the first or second position, relative positions of the contact portion 112 and the circuit unit 111 are not changed, and thus, a possibility of a short circuit of the signal line 113 with respect to the contact portion 112 and the circuit unit 111 may be significantly reduced. However, the embodiments are not limited thereto. For example, the contact portion 112 may be integrally formed with the circuit unit 111, and the signal line 113 may be omitted. Alternatively, as illustrated in FIG. 8, the circuit unit 111 may be fixed to the rear cover 104 or the toner cartridge 100 and just the contact portion 112 may be installed at the moving member 130. In this case, a wire holder 104-3 that is provided in the rear cover 104 and supports the signal line 113 may be located at an intermediate position of a stroke S when the contact portion 112 is moved to the first or second position. Accordingly, while the contact portion 112 is being moved, a variation in a length of the signal line 113 between the contact portion 112 and the circuit unit 111 may be minimized to thereby reduce the danger of a short circuit between the signal line 113 and the contact portion 112 or the circuit unit 111.

Figure 9A:
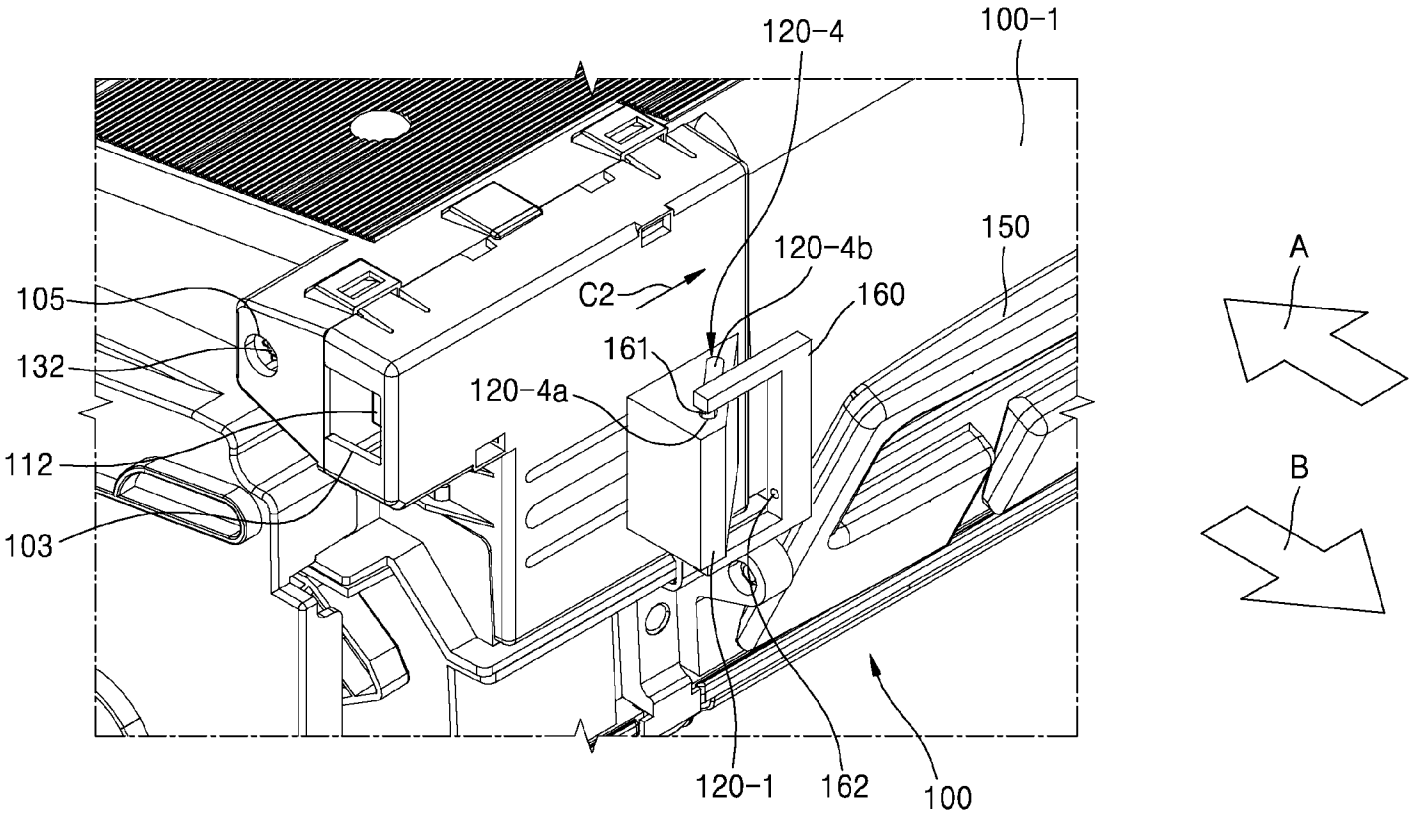
FIGS. 9A and 9B are schematic perspective views illustrating a toner cartridge having a structure in which a contact portion is moved to first and second positions via a closing operation of a door and in connection with a handle, according to an embodiment.
Figure 9B:
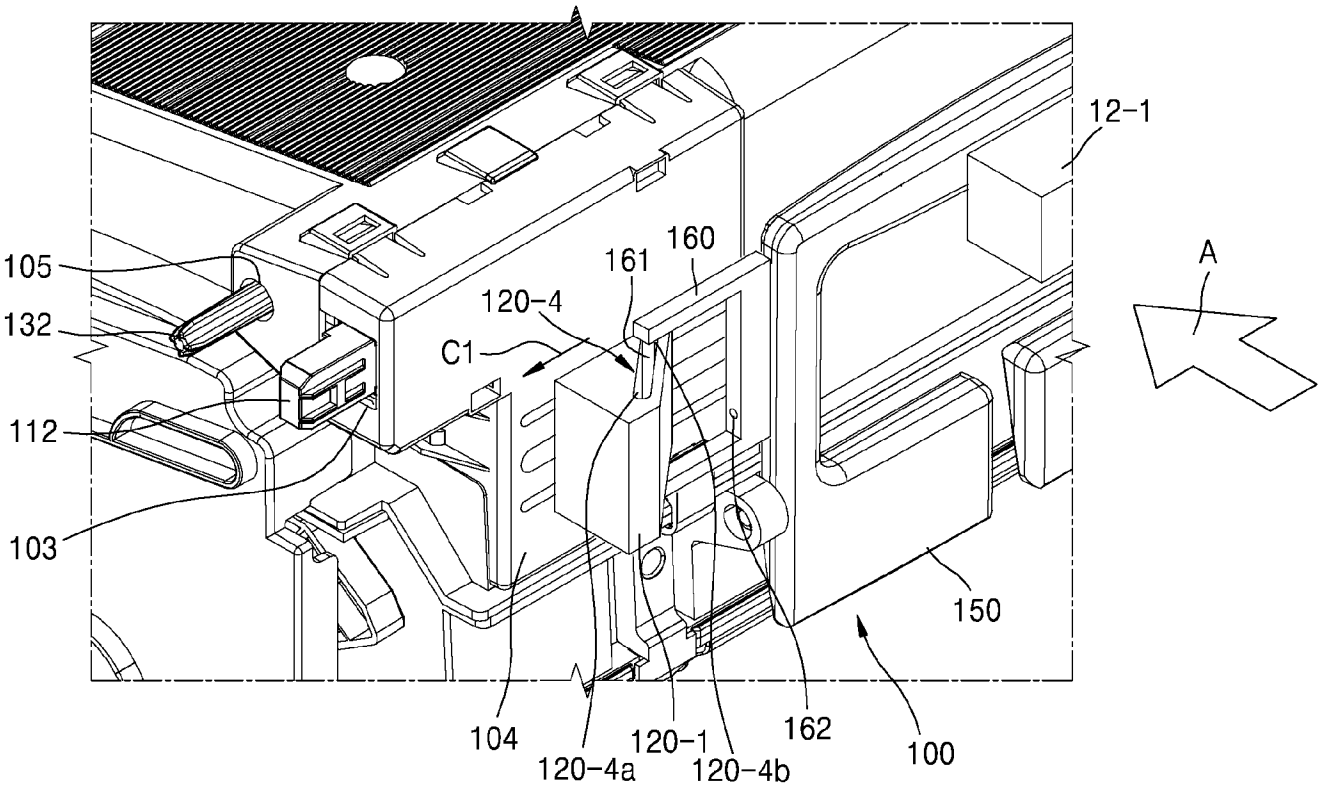

While a structure in which the push lever 12-1 of the door 12 pushes the moving member 130 to thereby move the contact portion 112 to the first or second position is described with reference to the above-described embodiment, the embodiments are not limited thereto. A handle 150 may be mounted at the toner cartridge 100 to be held by the user in an attaching or detaching operation to or from the main body 1. The moving member 130 may be connected to the handle 150 and the push lever 12-1 may push the handle 150 so as to move the contact portion 112 to the second position. FIGS. 9A and 9B are schematic perspective views illustrating the toner cartridge 100 having a structure in which the contact portion 112 is moved to the first or second position in connection with the handle 150, according to an embodiment. The structures for moving the contact portion 112 illustrated in FIGS. 9A and 9B are the same as the structure illustrated in FIG. 6. That is, as illustrated in FIG. 6, the contact portion 112 is installed at the moving member 130, and the protection member 132 is integrally formed with the moving member 130. A knob 120-1 is the same as the knob 120 illustrated in FIG. 6 except that the knob 120-1 includes an inclination guide groove 120-4. The push lever 12-1 provided at the door 12 has the same structure illustrated in FIGS. 4 and 5 except that it is disposed at a position corresponding to the handle 150.

Referring to FIGS. 9A and 9B, the handle 150 is pivotably installed at the rear portion 100-1 of the toner cartridge 100. The handle 150 may be disposed, for example, at a holding position protruding from the toner cartridge 100 to hold the toner cartridge 100 as illustrated in FIG. 9A, and may be pivoted from the holding position to an accommodation position that is close to the toner cartridge 100. A pivoting direction of the handle 150 may be, for example, the mounting direction A of the toner cartridge 100.

A pivoting movement of the handle 150 is converted into sliding movement of a moving member 130-1 by using a conversion unit. The conversion unit may be realized by, for example, the inclination guide groove 120-4 formed in the moving member 130-1 and a connection member 160 that connects the inclination guide groove 120-4 and the handle 150. The inclination guide groove 120-4 is inclined with respect to a moving direction of the contact portion 112 and may be formed in a knob 120-1. A guide post 161 that is inserted into the inclination guide groove 120-4 is provided at a first end of the connection member 160. A second end of the connection member 160 is connected to the handle 150. As the handle 150 is pivotably installed in the toner cartridge 100 in the mounting direction A, the connection member 160 and the handle 150 are pivotably connected to each other with respect to a pivot shaft 162 extending in the moving direction of the contact portion 112.

In order to mount the toner cartridge 100 in the main body 1, the handle 150 is pulled in an opposite direction to the mounting direction A, that is, in a detaching direction B as illustrated in FIG. 9A, so as to locate the handle 150 at the holding position that is separated from the rear portion 100-1 of the toner cartridge 100. When the handle 150 pivots, the connection member 160 follows the handle 150 and is moved in a direction away from the rear portion 100-1 of the toner cartridge 100, that is, in the detaching direction B. The guide post 161 is disposed at a first end portion 120-4*a* of the inclination guide groove 120-4, and the contact portion 112 and the protection member 132 are respectively located at the first position and the retreat position which are hidden inside the toner cartridge 100. In this state, the user places a hand into a space between the rear portion 100-1 of the toner cartridge 100 and the handle 150 to lift the toner cartridge 100. The handle 150 is maintained at a position separated from the rear portion 100-1 of the toner cartridge 100, and the contact portion 112 and the protection member 132 are respectively maintained at the first position and the retreat position.

Next, the door 12 is opened to insert the toner cartridge 100 into the main body 1 through the opening portion 11 along the guide rail 100-30 (FIG. 1) provided on the main body 1. When insertion of the toner cartridge 100 into the main body 1 is completed, the door 12 is closed.

When the door 12 is closed, the push lever 12-1 pushes the handle 150 in the mounting direction A as illustrated in FIG. 9B to pivot the handle 150 toward the rear portion 100-1 of the toner cartridge 100. Then the connection member 160 is moved toward the rear portion 100-1 of the toner cartridge 100, and the guide post 161 pushes an inner wall of the inclination guide groove 120-4. Due to this pushing force, the knob 120-1 and the moving member 130 slide in the direction C1 in which the contact portion 112 is moved to the second position. When the door 12 is completely closed, the handle 150 reaches an accommodation position, and the guide post 161 reaches a second end portion 120-4*b* of the inclination guide groove 120-4, and the contact portion 112 and the protection member 132 may be respectively disposed at the second position and the protruding position as illustrated in FIG. 9B. Accordingly, even though the user does not pivot the handle 150 to the accommodation position, the contact portion 112 is moved to the second position via an operation of the closing of the door 12 so as to be connected to the connection portion 40 provided in the main body 1.

When detaching the toner cartridge 100 from the main body 1, the door 12 is opened to pull the handle 150 in the detaching direction B and locate the same at the holding position. Then the connection member 160 is moved in a direction away from the rear portion 100-1 of the toner cartridge 100, and in this operation, the guide post 161 is moved from the second end portion 120-4*b* to the first end portion 120-4*a* while pulling the inner wall of the inclination guide groove 120-4. Accordingly, the knob 120-1 and a moving member 130 are slid in a direction C2 in which the contact portion 112 is moved to the first position. When the handle 150 reaches the holding position, as illustrated in FIG. 9A, the contact portion 112 and the protection member 132 are respectively returned to the first position and the retreat position. In this state, the user places a hand into a space between the toner cartridge 100 and the handle 150 to hold the handle 150 and pull the toner cartridge 100 to thereby detach the toner cartridge 100 from the main body 1.

Figure 10A:
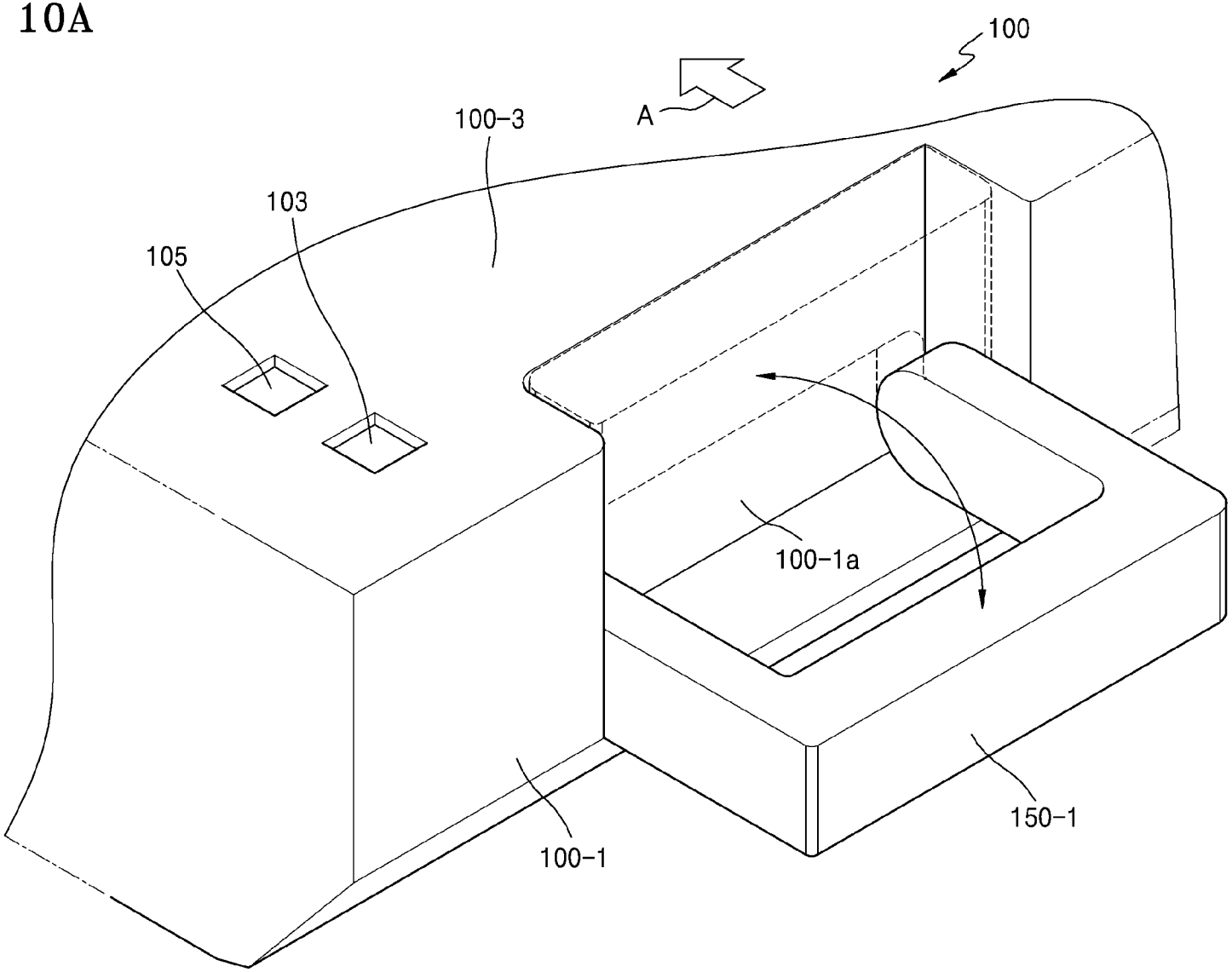
FIG. 10A is a partial perspective view illustrating a toner cartridge according to an embodiment.

FIG. 10A is a partial perspective view illustrating the toner cartridge 100 according to an embodiment. Referring to FIG. 10A, a handle 150-1 is provided in the toner cartridge 100. The handle 150-1 is pivotably installed on the toner cartridge 100. The handle 150-1 may be disposed, for example, at a holding position protruded from the toner cartridge 100 in order to hold the toner cartridge 100 as illustrated by a solid line. Also, the handle 150-1 may be pivoted from the holding position to a first accommodation position that is close to the toner cartridge 100 as illustrated by a dotted line. An accommodation portion 100-1*a* that is inwardly dented to accommodate the handle 150-1 located at the first accommodation position may be provided in the toner cartridge 100. The handle 150-1 is disposed to face the opening portion 11 so that a user may easily access the handle 150-1 while the toner cartridge 100 is mounted in the main body 1. According to the current embodiment, the handle 150-1 is pivotably installed at the rear portion 100-1 of the toner cartridge 100. Also, the accommodation portion 100-1*a* is inwardly dented in the rear portion 100-1. The contact portion 112 may be moved to the first or second position in connection with pivoting of the handle 150-1 to the holding position and the first accommodation position.

Figure 10B:
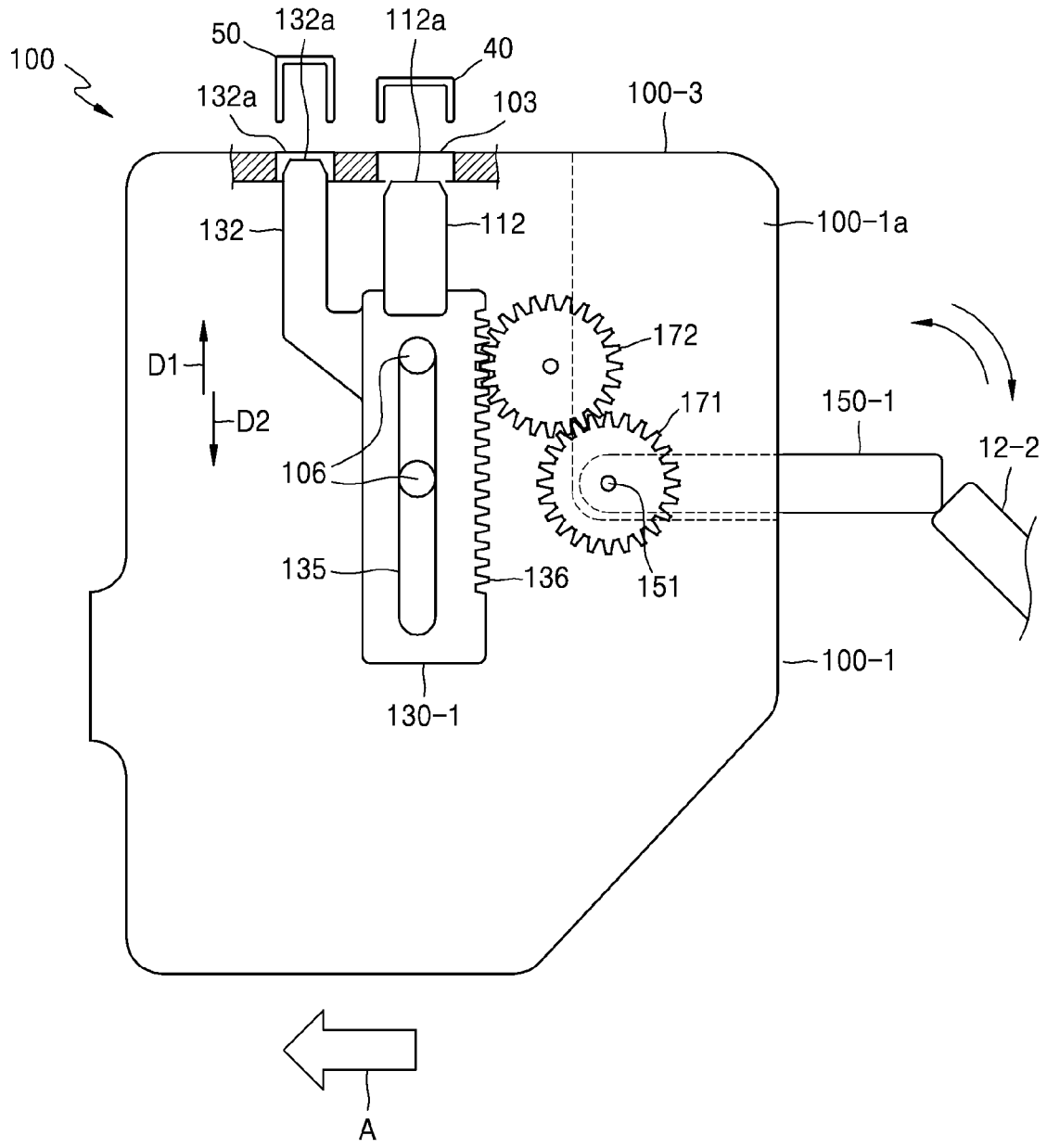
FIG. 10B is a schematic lateral structural diagram of the toner cartridge having a structure in which a contact portion is moved to a first or second position in connection with a handle, wherein the handle is located at a holding position.
Figure 10C:
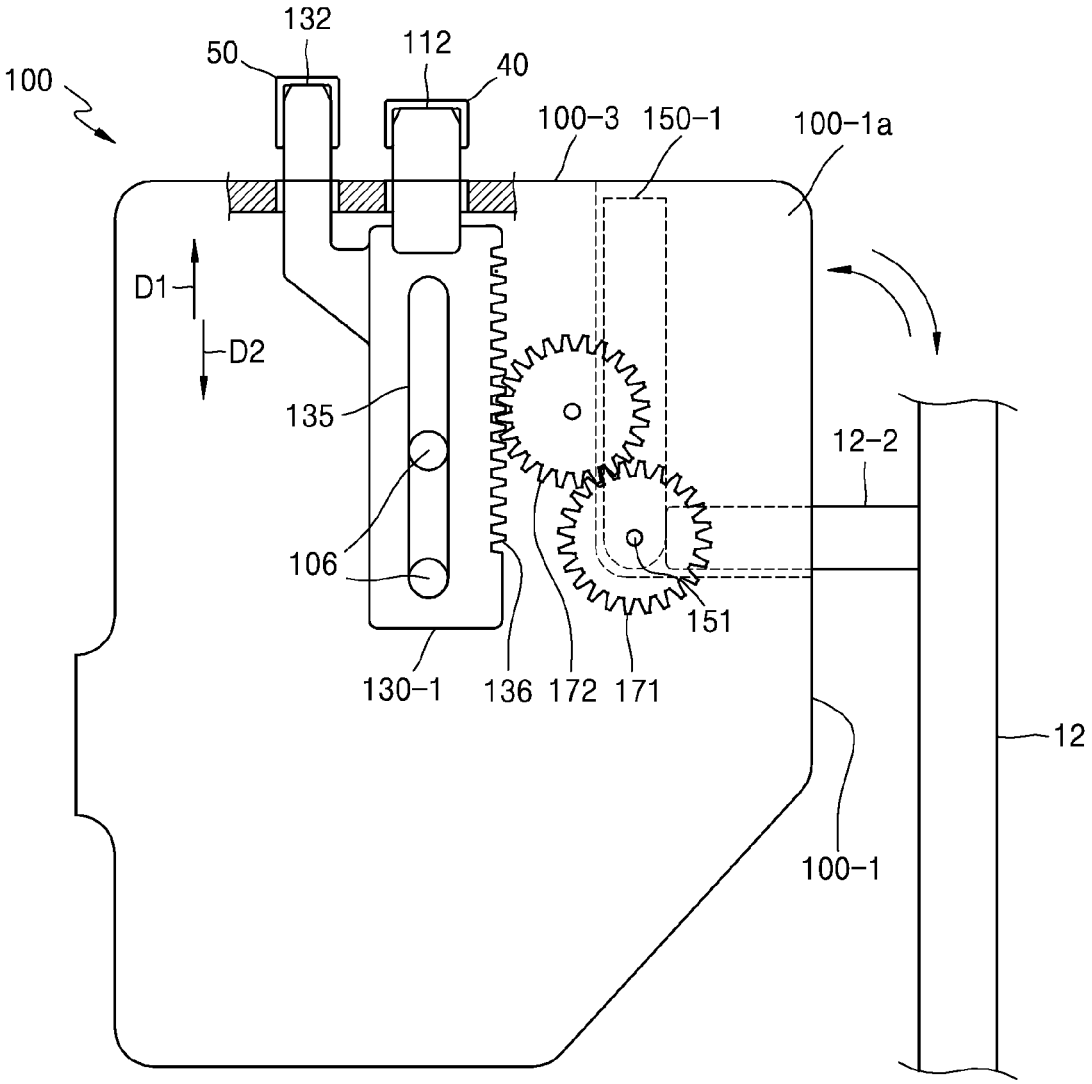
FIG. 10C is a schematic lateral structural diagram of the toner cartridge having a structure in which a contact portion is moved to a first or second position in connection with a handle, wherein the handle is located at a first accommodation position.

FIGS. 10B and 10C are schematic lateral structural diagrams of a structure in which the contact portion 112 is moved to the first or second position in connection with the handle 150-1, respectively showing the handle 150-1 located at the holding position and the first accommodation position. According to the current embodiment, the contact portion 112 is moved in a height direction of the toner cartridge 100 that is orthogonal to the mounting direction A so that the contact portion 112 is located at the second position protruding from the upper portion 100-3 of the toner cartridge 100.

Referring to FIGS. 10B and 10C, the moving member 130-1 is slidably installed in the toner cartridge 100 in a vertical direction. For example, guide pins 106 that are vertically separated are disposed in the toner cartridge 100, and a guide slot 135 that is formed by cutting in a vertical direction such that the guide pin 106 may be inserted into the guide slot 135 may be formed. The contact portion 112 is mounted on the moving member 130-1. A first outlet 103 through which the contact portion 112 moves in and out is formed in the upper portion 100-3 of the toner cartridge 100. The protection member 132 may be integrally formed with the moving member 130-1, and the second outlet 105 through which the protection member 112 moves in and out may be further formed at the upper portion 100-3 of the toner cartridge 100. The connection portion 40 and the insertion portion 50 are disposed above the toner cartridge 100. The toner cartridge 100 includes a conversion unit that converts pivoting of the handle 150-1 into a sliding movement of the moving member 130-1. The conversion unit may be realized by, for example, a pinion-rack gear structure. The conversion unit may include at least one pinion, here, pinions 171 and 172, and a rack gear 136 that is provided in the moving member 130-1 and is engaged with the pinion 172. While the pinions 171 and 172 are used in the current embodiment, the embodiments are not limited thereto. The number of pinions is set in consideration of a pivoting direction of the handle 150-1 so that the contact portion 112 is respectively located at the first position and the second position when the handle 150-1 is located at the holding position and the first accommodation position. For example, according to the embodiment illustrated in FIGS. 10A through 10C, the handle 150-1 is pivoted counterclockwise to be converted from the holding position to the first accommodation position. However, alternatively, the handle 150-1 may also be pivoted clockwise to be converted from the holding position to the first accommodation position. In this case, the pinion 172 is not necessary, and it is sufficient when the pinion 171 and the rack gear 136 engage with each other. That is, an even or odd number of pinions may be used in consideration of a pivoting direction of the handle 150-1 and a sliding direction of the moving member 130-1.

According to the toner cartridge 100 of the current embodiment, the handle 150-1 is pivoted from the holding position to the first accommodation position via an operation of closing the door 12. The handle 150-1 is pivotably installed at the rear portion 100-1 of the toner cartridge 100 such that the handle 150-1 is disposed at a position facing the door 12 while the toner cartridge 100 is mounted in the main body 1. A push lever 12-2 via which to push the handle 150-1 to pivot the same to the first accommodation position when the door 12 is closed is provided at the door 12.

In order to mount the toner cartridge 100 in the main body 1, as illustrated in FIG. 10B, the handle 150-1 which is at the holding position is held to insert the toner cartridge 100 into the main body 1 through the opening portion 11 along the guide rail 30 (FIG. 3B) provided on the main body 1. While the handle 150-1 is located at the holding position, the contact portion 112 and the protection member 132 are respectively located at the first position and the retreat position.

When insertion of the toner cartridge 100 in the main body 1 is completed, the door 12 is closed. As illustrated in FIG. 10B, as the door 12 is closed, the push lever 12-2 contacts the handle 150-1, and the handle 150-1 is pushed by the push lever 12-2 to be pivoted with respect to the pivot shaft 151 to the first accommodation position. Then the pinions 171 and 172 connected to the pivot shaft 151 are also rotated, and rotation of the pinions 171 and 172 is converted into a sliding movement via the rack gear 136, and the moving member 130-1 slides in a direction D1. The contact portion 112 is protruded from the upper portion 100-3 of the toner cartridge 100 via the first outlet 103 and is moved toward the connection portion 40. The protection member 132 protrudes from the upper portion 100-3 of the toner cartridge 100 through the second outlet 105 and is moved toward the insertion portion 50.

The front end portion 132*a* of the protection member 132 is located further upwards than the front end portion 112*a* of the contact portion 112, and thus, the protection member 132 is first inserted into the insertion portion 50 so as to align the contact portion 112 and the connection portion 40. Then, the contact portion 112 is inserted into the connection portion 40.

When the door 12 is completely closed, as illustrated in FIG. 10C, the handle 150-1 reaches the first accommodation position, and the contact portion 112 and the protection member 132 are respectively disposed at the second position and the protruding position. Accordingly, even though the user does not move the handle 150-1 to the first accommodation position, the contact portion 112 is moved to the second position via an operation of the closing of the door 12 so as to be connected to the connection portion 40 provided in the main body 1.

Next, an operation of detaching the toner cartridge 100 from the main body 1 will be described. First, the door 12 is opened. Although the door 12 is opened, the handle 150-1 is maintained at the first accommodation position as illustrated in FIG. 10C, and the contact portion 112 and the protection member 132 are respectively maintained at the second position and the protruding position. The handle 150-1 is pulled to be pivoted to the holding position. Then the pinions 171 and 172 connected to the pivot shaft 151 are also rotated, and rotation of the pinions 171 and 172 is converted into sliding movement via the rack gear 136 and the moving member 130-1 slides in a direction D2. When the handle 150-1 is located at the holding position, the contact portion 112 and the protection member 132 respectively return to the first position and the retreat position as illustrated in FIG. 10B. In this state, the handle 150-1 is held to pull the toner cartridge 100 to thereby detach the toner cartridge 100 from the main body 1.

When the toner cartridge 100 is separated from the main body 1, if the handle 150-1 is located at the holding position, an external appearance of the toner cartridge 100 is increased. When moving the handle 150-1 to the first accommodation position, the external appearance of the toner cartridge 100 is reduced but the contact portion 112 protrudes and is thus is likely to be damaged. Considering this, a method of reducing the external appearance of the toner cartridge 100 in the case when the toner cartridge 100 is separated from the main body 1 is required.

Figure 11A:
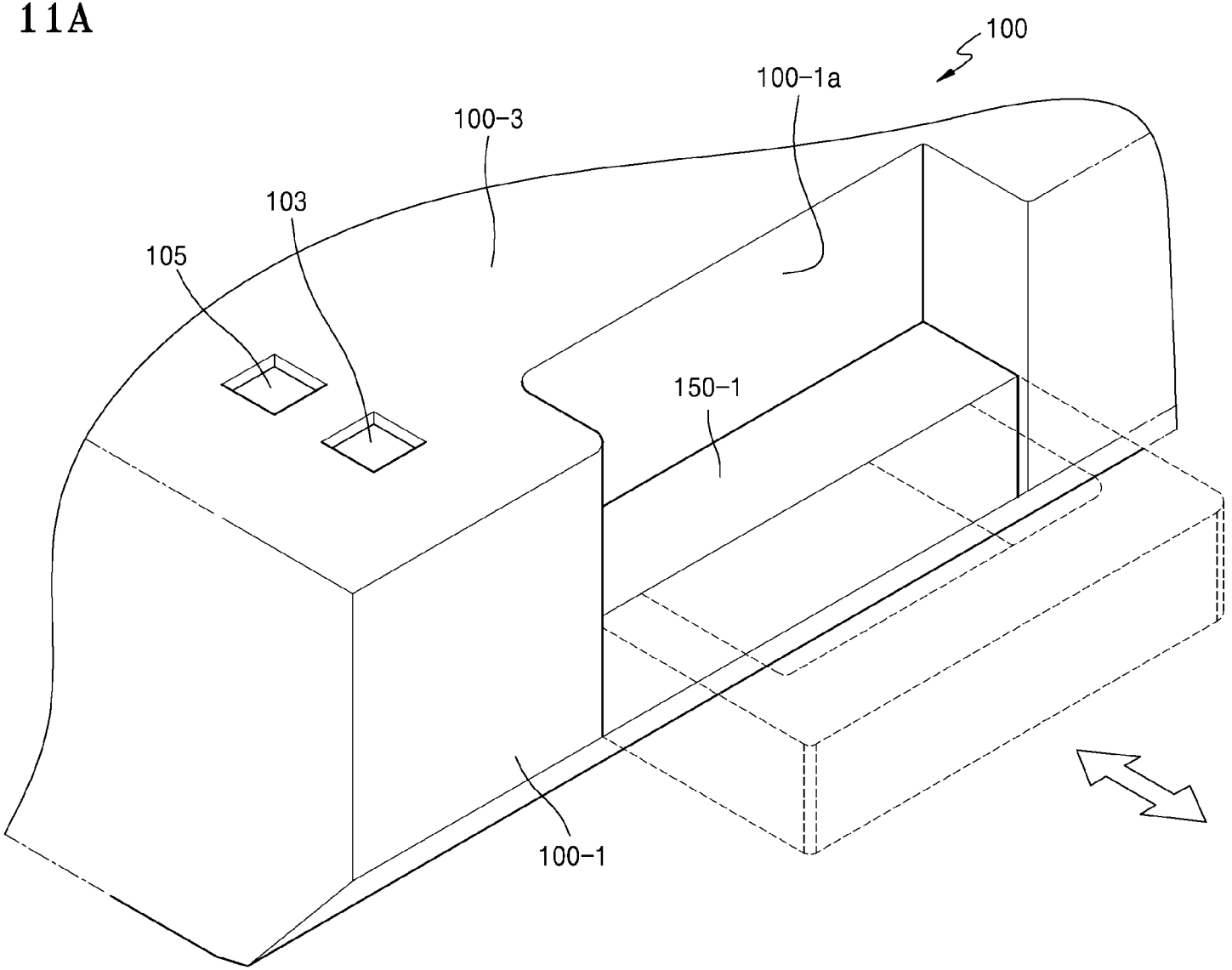
FIG. 11A is a perspective view of a toner cartridge according to an embodiment.
Figure 11B:
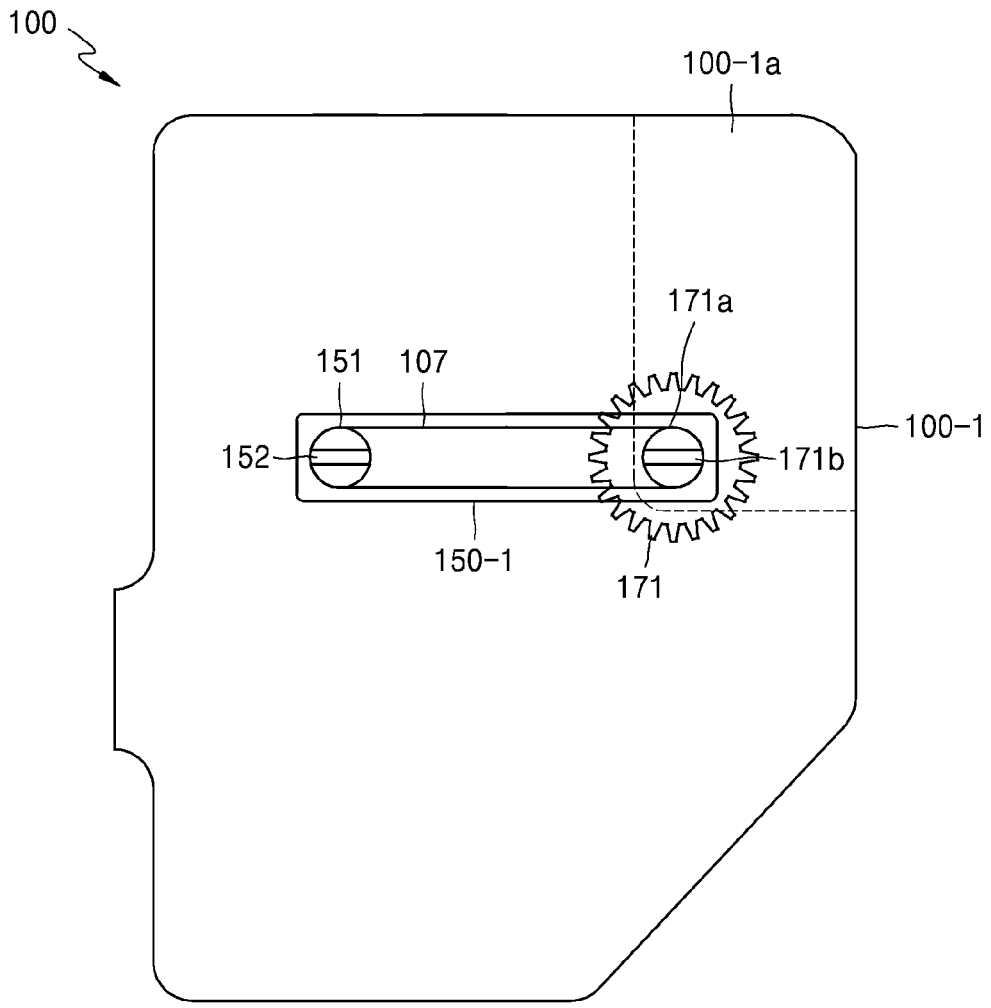
FIG. 11B is a schematic lateral view of the toner cartridge of FIG. 11A, wherein a handle is located at a second accommodation position.
Figure 11C:
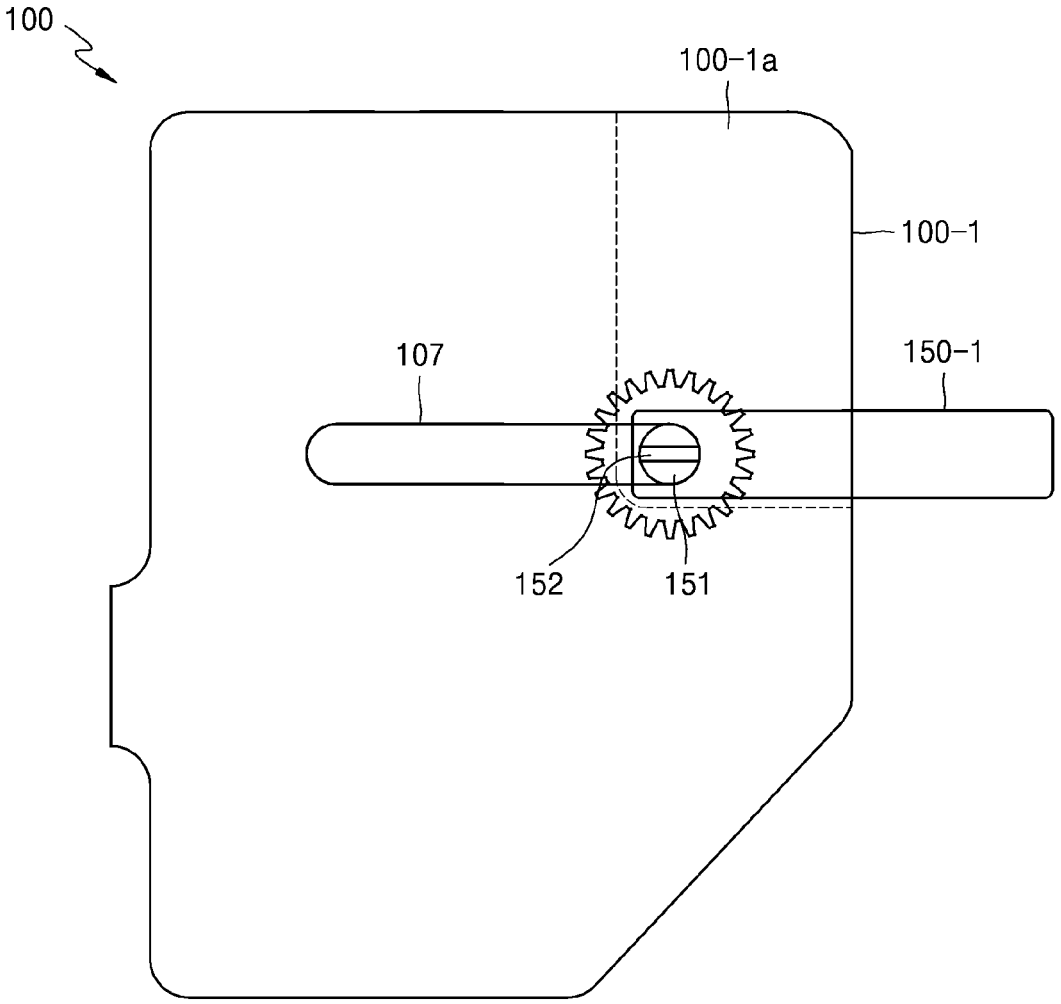
FIG. 11C is a schematic lateral view of the toner cartridge of FIG. 11A, wherein a handle is located at a holding position.
Figure 11D:
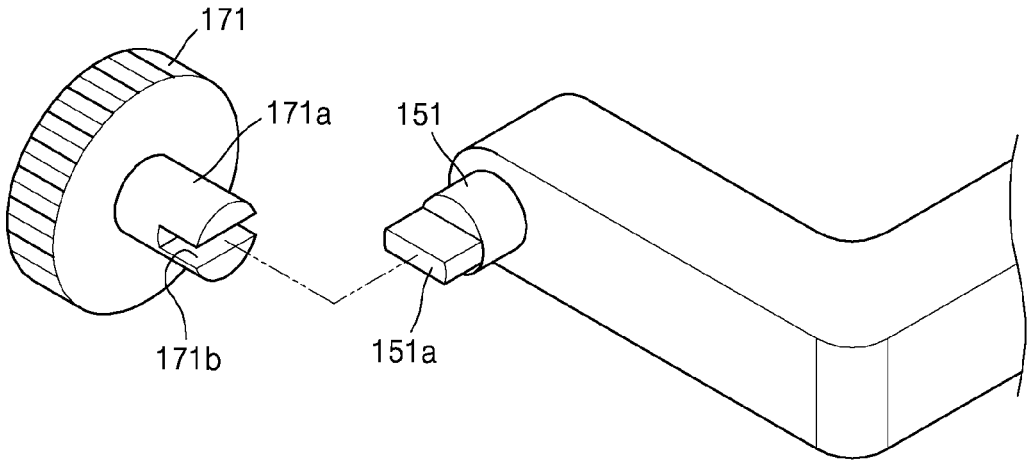
FIG. 11D is an exploded perspective view illustrating a connection relationship between a pivot shaft of a handle and a pinion, according to an embodiment.
Figure 11E:
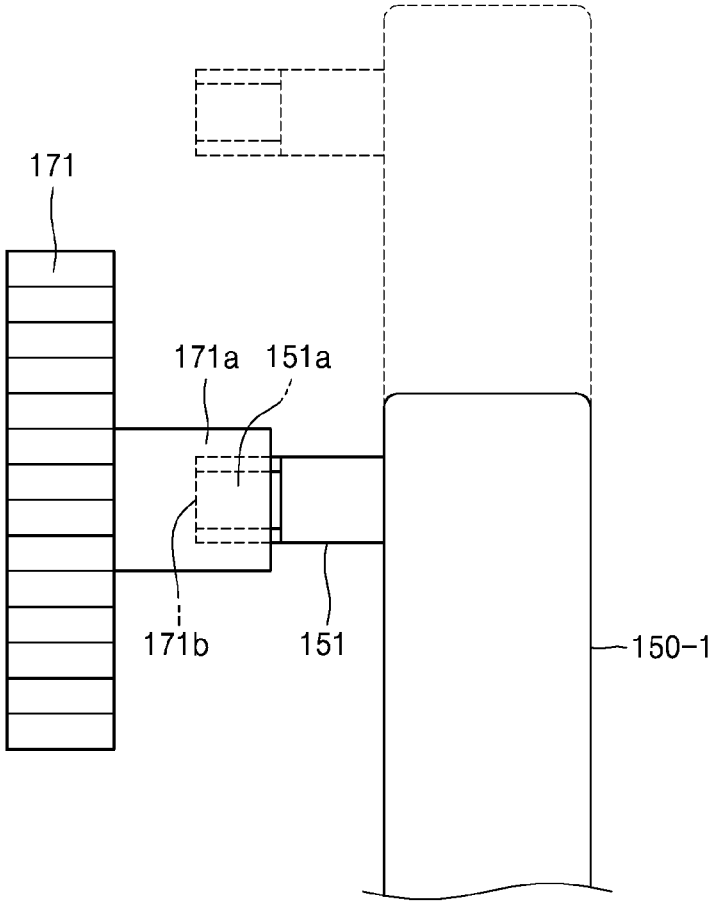
FIG. 11E is a plan view illustrating a connection relationship between a pivot shaft of a handle and a pinion, according to an embodiment.

FIG. 11A is a perspective view of the toner cartridge 100 according to an embodiment, and FIG. 11B is a schematic lateral view of the toner cartridge 100 of FIG. 11A, wherein the handle 150-1 is located at a second accommodation position. FIG. 11C is a schematic lateral view of the toner cartridge 100 of FIG. 11A, wherein the handle 150-1 is located at a holding position. FIGS. 11D and 11E are respectively an exploded perspective view and a plan view illustrating a connection relationship between the pivot shaft 151 of the handle 150-1 and the pinion 171, according to an embodiment.

Referring to FIG. 11A, the handle 150-1 is slid to the holding position (illustrated by a dotted line) and the second accommodation position accommodated in the accommodation portion 100-1*a* provided in the rear portion 100-1 of the toner cartridge 100. To this end, referring to FIGS. 11B and 11C, a guide slot 107 is provided in the toner cartridge 100. The pivot shaft 151 is inserted into the guide slot 107 and slides along the guide slot 107. According to the above structure, the handle 150-1 that moves to the holding position and the second accommodation position may be realized.

The toner cartridge 100 illustrated in FIGS. 11A through 11E is identical to the toner cartridge 100 illustrated in FIGS. 10A through 10C except that the handle 150-1 slides to the holding position and the second accommodation position. Accordingly, movement of the contact portion 112 to the first and second positions as the handle 150-1 is pivoted to the holding position and the first accommodation position will be described with reference to FIGS. 10A through 10C.

The handle 150-1 may be pivoted from the holding position to the first accommodation position illustrated in FIG. 10A. The pivot shaft 151 of the handle 150-1 is connected to a conversion unit when the handle 150-1 is located at the holding position and the first accommodation position, and is released from the conversion unit when the handle 150-1 is located at the second accommodation position. For example, when the handle 150-1 is located at the second accommodation position, connection between the pinion 171 and the pivot shaft 151 is released, and the pinion 171 and the pivot shaft 151 may be connected to each other when the handle 150-1 is located at the holding position. Accordingly, by moving the handle 150-1 to the holding position and the first accommodation position as illustrated in FIGS. 10B and 10C, the contact portion 112 may be moved to the first or second position. Referring to FIGS. 11D and 11E, first and second coupling portions 151*a* and 171*b* are provided at the pivot shaft 151 and the pinion 171, respectively. The first and second coupling portions 151*a* and 171*b* may have complementary forms such that the pinion 171 may also be pivoted when the handle 150-1 is pivoted. For example, the first coupling portion 151*a* may be in the form of an extension piece extending in a sliding direction of the handle 150-1, and the second coupling portion 171*b* may be in the form of an extension groove that is formed in a central shaft 171*a* of the pinion 171 by cutting such that the extension piece may be inserted thereinto. According to the above structure, as illustrated in FIG. 11E by a dotted line, when the handle 150-1 is located at the second accommodation position, a connection between the pivot shaft 151 and the pinion 171 is released, and when the handle 150-1 slides to the holding position, the first coupling portion 151*a* is inserted into the second coupling portion 171*b* so that the pivot shaft 151 and the pinion 171 are connected to each other, and when the handle 150-1 is pivoted to the first accommodation position, the pinion 171 is also rotated. During separation from the main body 1, the handle 150-1 is also located at the second accommodation position as illustrated in FIG. 11A by a solid line. In this state, a connection between the pivot shaft 151 and the pinion 171 is released. The contact portion 112 and the protection member 132 are respectively located at the first position and the retreat position as illustrated in FIG. 10B.

To mount the toner cartridge 100 in the main body 1, the handle 150-1 is pulled to be slid to the holding position as illustrated in FIG. 11A by a dotted line. When the handle 150-1 reaches the holding position, the first coupling portion 151*a* formed at the pivot shaft 151 is coupled to the second coupling portion 171*b* of the pinion 171 so that the pivot shaft 151 and the pinion 171 are connected to each other. The contact portion 112 and the protection member 132 are respectively maintained at the first position and the retreat position as illustrated in FIG. 10B.

In this state, as described above with reference to FIGS. 10B and 10C, when the toner cartridge 100 is mounted in the main body 1 and the door 12 is closed, the push lever 12-2 provided at the door 12 pushes the handle 150-1 so as to pivot the handle 150-1 to the first accommodation position, and the contact portion 112 and the protection member 132 are respectively moved to the second position and the protruding position via pivoting of the handle 150-1, so as to be respectively inserted into the connection portion 40 and the insertion portion 50.

An operation of detaching the toner cartridge 100 is also the same as described with reference to FIGS. 10C and 10B. When detachment of the toner cartridge 100 is completed, the handle 150-1 is pushed to be slid to the second accommodation position. Then the first coupling portion 151*a* provided at the pivot shaft 151 is separated from the second coupling portion 171*b* of the pinion 171, and connection between the pivot shaft 151 and the pinion 171 is released, and the contact portion 112 and the protection member 132 are respectively maintained at the first position and the retreat position. By locating the handle 150-1 at the second accommodation position, the toner cartridge 100 may maintain a small external appearance during separation from the main body 1. The toner cartridge 100 in the form as described above has a small size in a packed state when it is provided as a consumable, and thus loading costs for transportation may be reduced.

Figure 12:
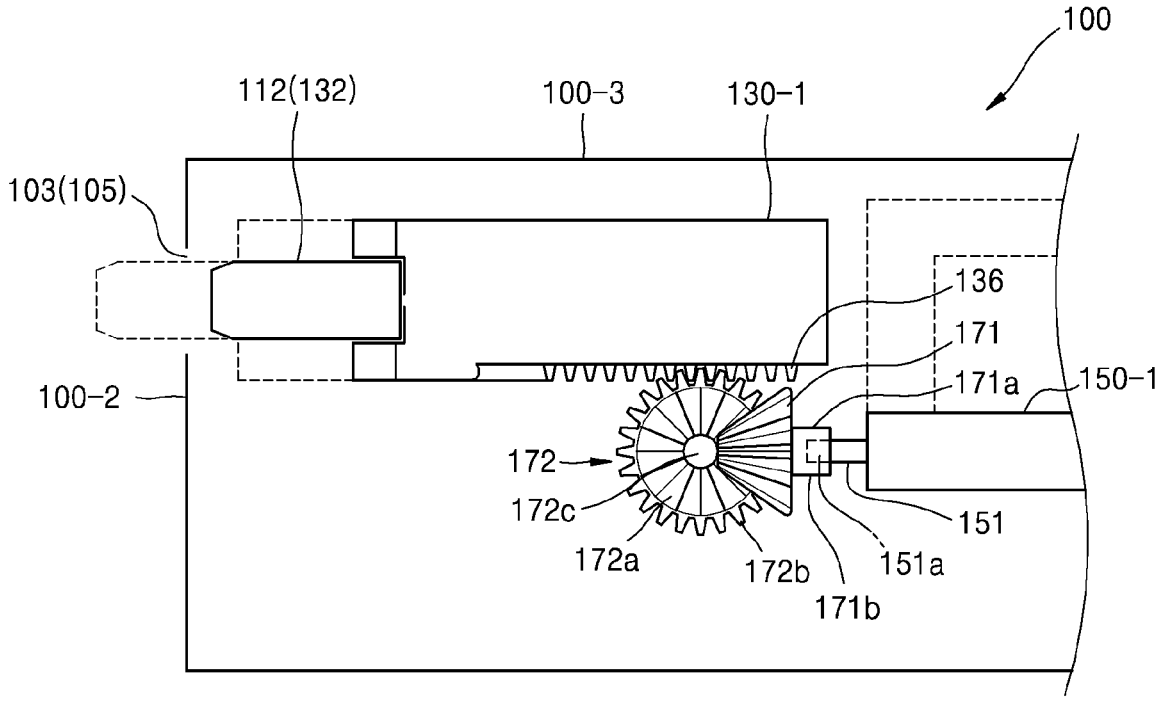
FIG. 12 is a schematic rear view of a toner cartridge according to an embodiment.

The embodiments illustrated in FIGS. 10A through 10C and FIGS. 11A through 11E may be modified to a structure in which the contact portion 112 is protruded from the side portion 100-2 of the toner cartridge 100. FIG. 12 is a schematic rear view of the toner cartridge 100 according to an embodiment. According to the embodiment of FIG. 12, the contact portion 112 is located at the second position protruding from the side portion 100-2 of the toner cartridge 100.

Referring to FIG. 12, the pinion 171 connected to the pivot shaft 151 of the handle 150-1 is a bevel gear. The pinion 172 connected to the pinion 171 includes a bevel gear 172*a* and a spur gear 172*b*. The bevel gear 172*a* and the spur gear 172*b* have a common rotation shaft 172*c*, and are separated from each other in a direction to the rotation shaft 172*c*. The pinion 171 and the pinion 172 have rotation shafts that are orthogonal to each other. According to the above structure, the pinion 171, the bevel gear 172*a*, the spur gear 172*b*, and the rack gear 136 are sequentially connected, and the moving member 130-1 may slide via pivoting of the handle 150-1 from the holding position to the first accommodation position (illustrated in FIG. 12 by a dotted line) so that the contact portion 112 and the protection member 132 are respectively located at the second position and the protruding position protruding from the side portion 100-2 of the toner cartridge 100. While not illustrated in the drawings, the moving member 130-1 may also slide in a direction in which the contact portion 112 and the protection member 132 are protruded from a front side of the toner cartridge 100 according to an arrangement angle of the pinion 171, which is in the form of a bevel gear, and the bevel gear 172*a*.

According to the above embodiments, the contact portion 112 is moved from the first position to the second position via an operation of closing the door 12, and the contact portion 112 returns from the second position to the first position via an operation of sliding the knob 120 or pivoting the handle 150 or 150-1. Hereinafter, a structure according to embodiments in which the contact portion 112 is moved to first and second positions via operations of opening and closing of the door 12 will be described.

Figure 13:
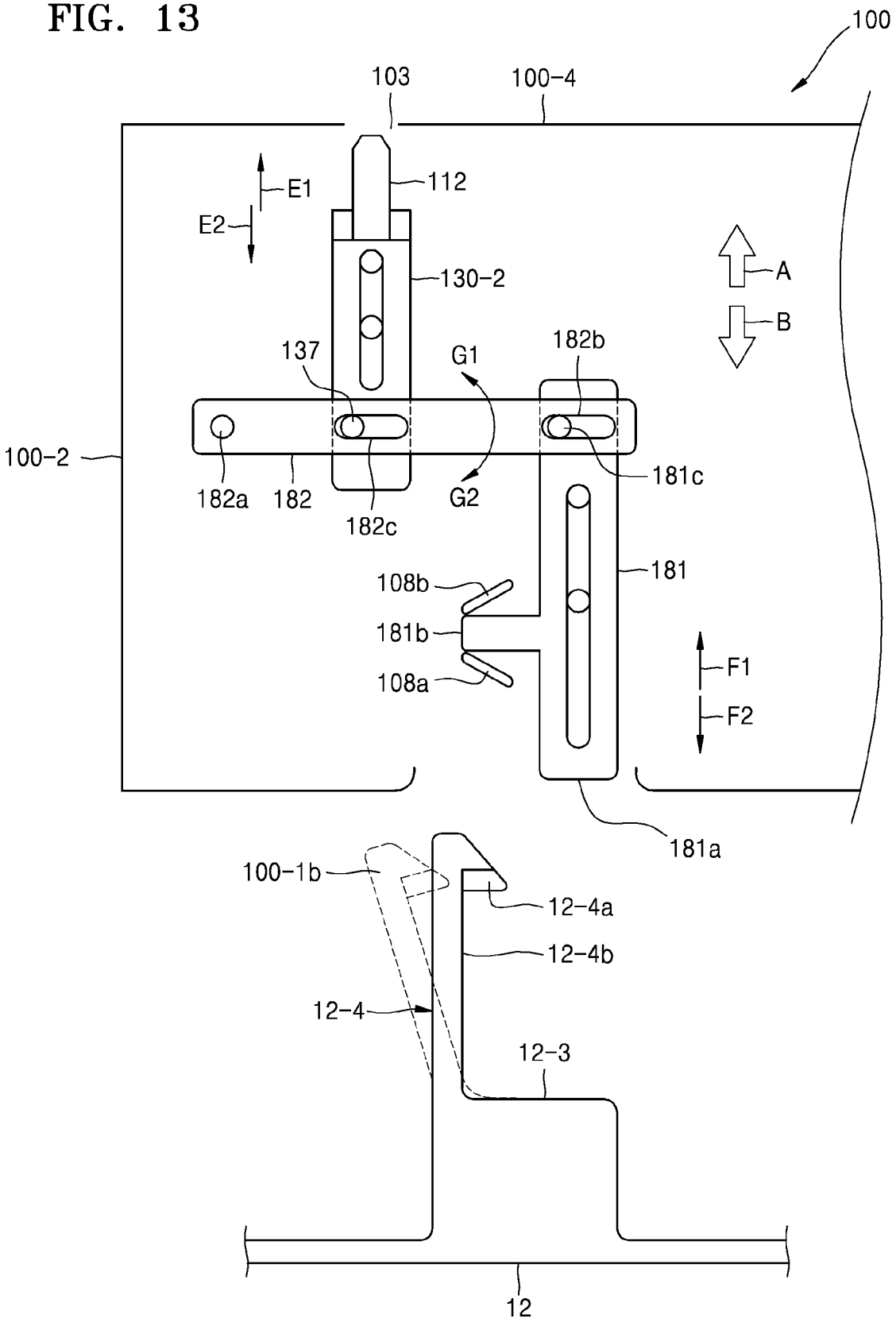
FIG. 13 is a schematic plan view of an image forming apparatus having a structure in which a contact portion is moved to first and second positions via opening and closing operations of a door, according to an embodiment.

FIG. 13 is a schematic plan view of an image forming apparatus having a structure in which the contact portion 112 is moved to first and second positions via opening and closing operations of the 12 door, according to an embodiment. In FIG. 13, only a relationship between the toner 100 and the door 12 is illustrated and other components of the image forming apparatus are omitted.

Referring to FIG. 13, the moving member 130-2 on which the contact portion 112 is mounted is slidably installed in the toner cartridge 100 in a mounting direction A and a detaching direction B, for example, in a forward or backward direction of the toner cartridge 100. Also, a first lever 181 that slides via opening and closing operations of the door 12 and a second lever 182 that is connected to the first lever 181 and is pivoted via a sliding operation of the first lever 181 are installed in the toner cartridge 100.

The first lever 181 includes a first portion 181*a* that is pushed by a push lever 12-3 provided at the door 12 when the door 12 is closed and a second portion 181*b* on which the pull lever 12-4 provided at the door 12 is hooked when the door 12 is opened. As an example of a structure that enables the first lever 181 to be slidably supported, a slot that is formed by cutting in a sliding direction may be formed in the first lever 181 and a guide pin that is inserted into the slot may be provided on the toner cartridge 100. However, the above structure is an example, and various structures well-known in the art, to which the first lever 181 may be slidably supported, such as a guide rail or guide protrusion, may be used.

The second lever 182 is pivotably installed with respect to a pivot shaft 182*a* formed at a first end thereof. The first lever 181 is connected to a second end of the second lever 182. For example, a connection pin 181*c* may be provided at the first lever 181, and a slot 182*b* into which the connection pin 181*c* is inserted may be provided in the second lever 182. According to the above structure, when the first lever 181 slides in directions F1 and F2, the second lever 182 may be pivoted in directions G1 and G2, respectively.

The moving member 130-2 is connected between the first and second ends of the second lever 182. The moving member 130-2 is connected to the second lever 182 via a connection unit. The connection unit according to the current connects the second lever 182 and the moving member 130-2 such that the moving member 130-2 slides on the same plane as a pivoting plane of the second lever 182. For example, the connection unit may include a connection pin 137 provided on the moving member 130-2 and a slot 182*c* which is provided in the second lever 182 and into which the connection pin 137 is inserted. According to the above structure, the moving member 130-2 slides in a direction E1 or E2 according to a pivoting direction of the second lever 182, and the contact portion 112 may be moved to the second position that is protruded through the first exit 103 formed at the front portion 100-4 of the toner cartridge 100 and is connected to the connection portion 40 (not shown) or to the first position that is accommodated in the toner cartridge 100.

As described above, the push lever 12-3 and the pull lever 12-4 are provided at the door 12. A hook 12-4*a* that is caught by the second portion 181*b* of the first lever 181 when the door 12 is opened is provided at an end portion of the pull lever 12-4. When the door 12 is closed, the hook 12-4*a* escapes from the second portion 181*b* of the first lever 181. To this end, the pull lever 12-4 may include an elastic arm 12-4*b* provided at the door 12 to be elastically bendable. The hook 12-4*a* may be installed at an end of the elastic arm 12-4*b*. A first guide portion 108*a* that guides the hook 12-4*a* such that the hook 12-4*a* escapes to the second portion 181*b* of the first lever 181 when the door 12 is closed may be provided in the toner cartridge 100. In addition, in the toner cartridge 100, a second guide portion 108*b* is provided, which guides the hook 12-4*a* such that the hook 12-4*a* escapes from the second portion 181*b* of the first lever 181 after the contact portion 112 has reached the first position when the door 12 is opened. After the hook 12-4*a* has escaped from the second portion 181*b* of the first lever 181 when the door 12 is closed, the push lever 12-3 contacts the first portion 181*a* of the first lever 181 to push the first lever 181 to slide the same in the direction F1. To this end, the hook 12-4*a* is disposed more inwards than the push lever 12-3, that is, further protrudes toward the toner cartridge 100. The push lever 12-3 does not interfere with the first and second guide portions 108*a* and 108*b*.

Figure 14:
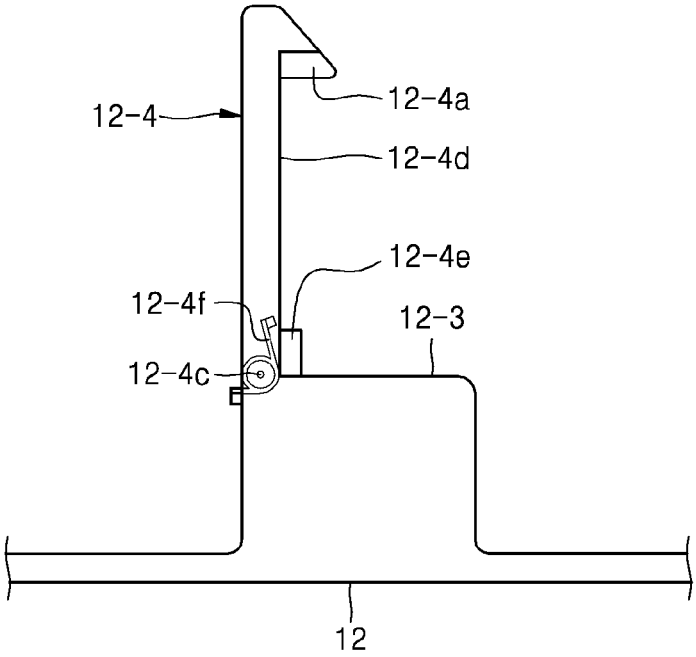
FIG. 14 is a plan view of a pull lever according to another embodiment.

FIG. 14 is a plan view of a pull lever 12-4 according to another embodiment. Referring to FIG. 14, the pull lever 12-4 may include a pivoting arm 12-4*d* that is pivotably installed at the door 12 with respect to a pivot shaft 12-4*c*. The hook 12-4*a* is installed at an end portion of the pivoting arm 12-4*d*. An elastic member 12-4*f* provides an elastic force to the pivoting arm 12-4*d* such that the hook 12-4*a* is pivoted in a direction to be hooked on the second portion 181*b* of the first lever 181. A stopper 12-4*e* restricts a pivoting range of the pivoting arm 12-4*d* such that the hook 12-4*a* which is caught by the second portion 181*b* of the first lever 181 does not pivot any more in a direction of an elastic force of the elastic member 12-4*f*.

Figure 15:
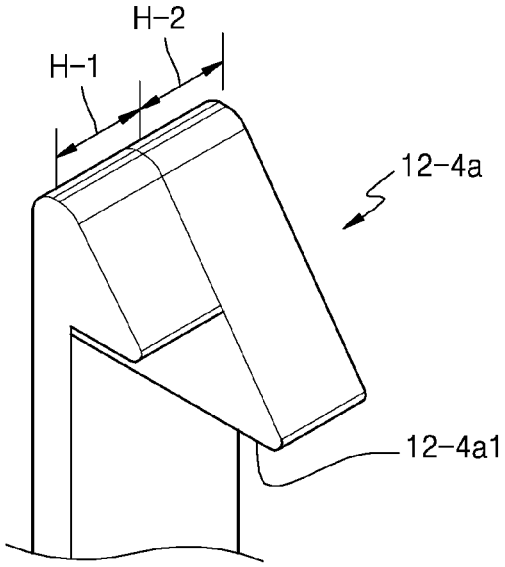
FIG. 15 is a detailed perspective view of a hook.

FIG. 15 is a detailed perspective view of the hook 12-4*a*. Referring to FIG. 15, the hook 12-4*a* includes an interference portion H-1 that interferes with the first and second guide portions 108*a* and 108*b* and a non-interference portion H-2 that does not interfere with the first and second guide portions 108*a* and 108*b*. A pulling portion 12-4*a*1 that pulls the second portion 181*b* of the first lever 181 is disposed in the non-interference portion H-2.

Figure 16A:
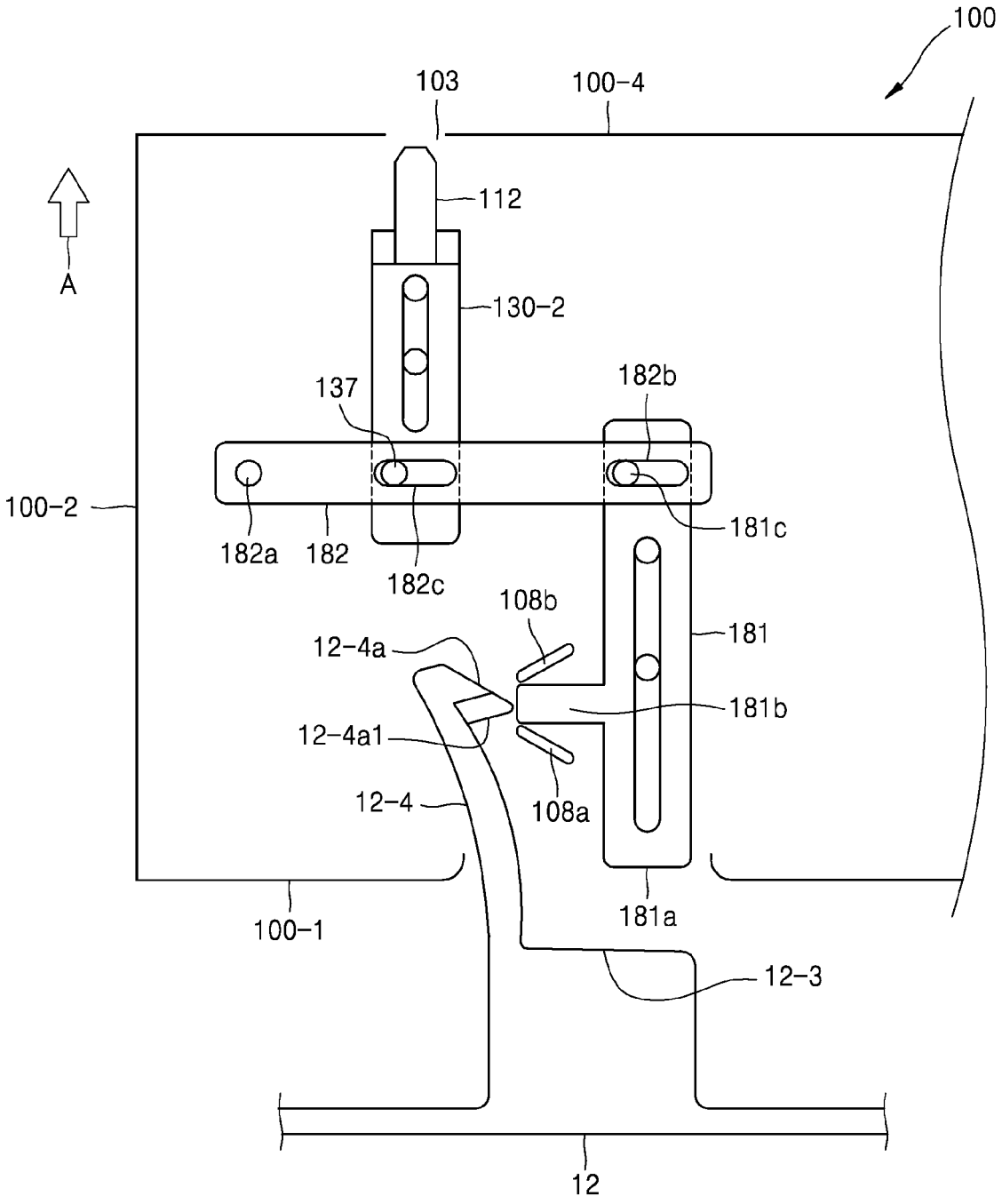
FIGS. 16A through 16C are plan views illustrating an operation of mounting or detaching a toner cartridge to or from a main body, according to an embodiment.
Figure 16B:
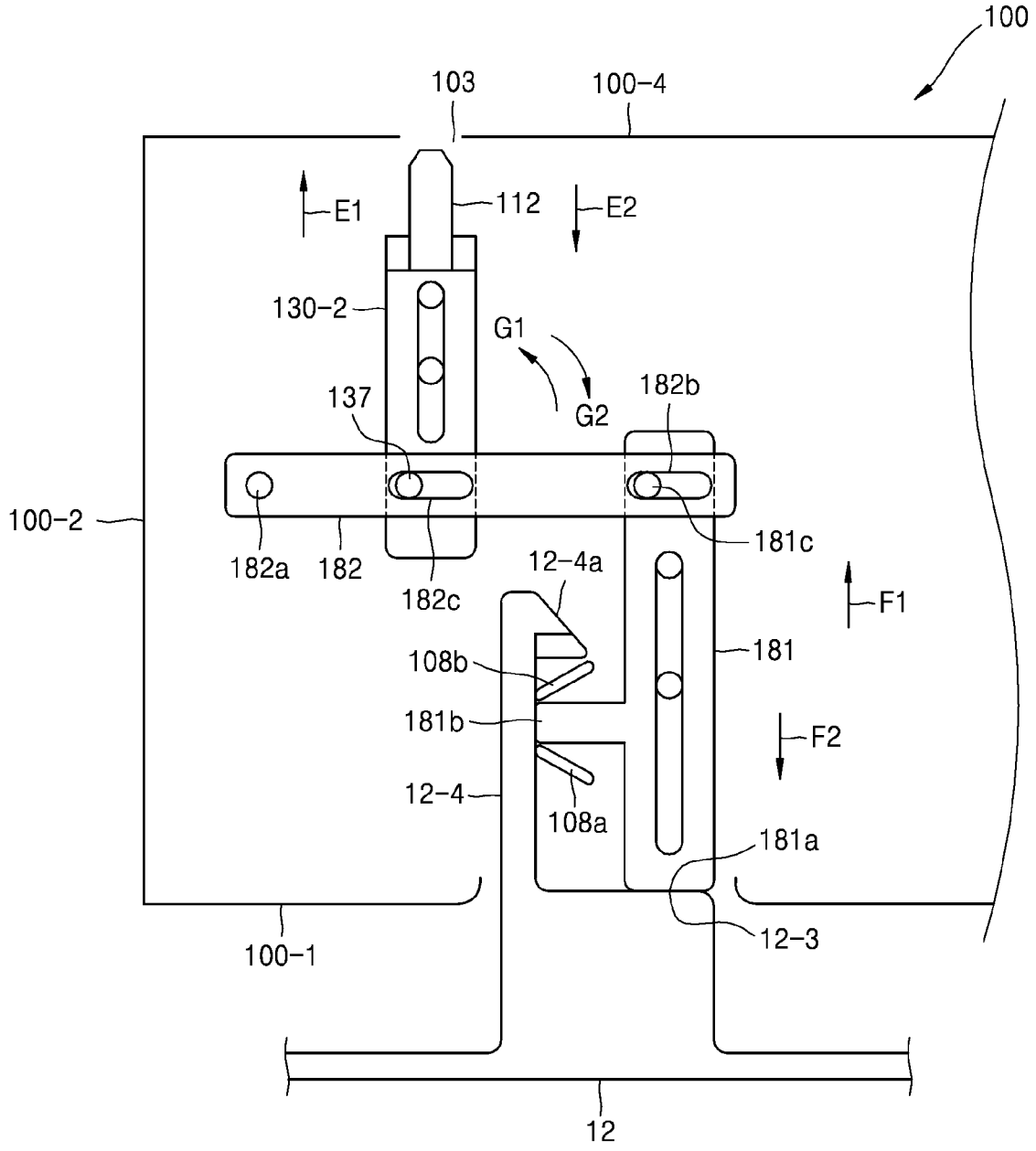
Figure 16C:
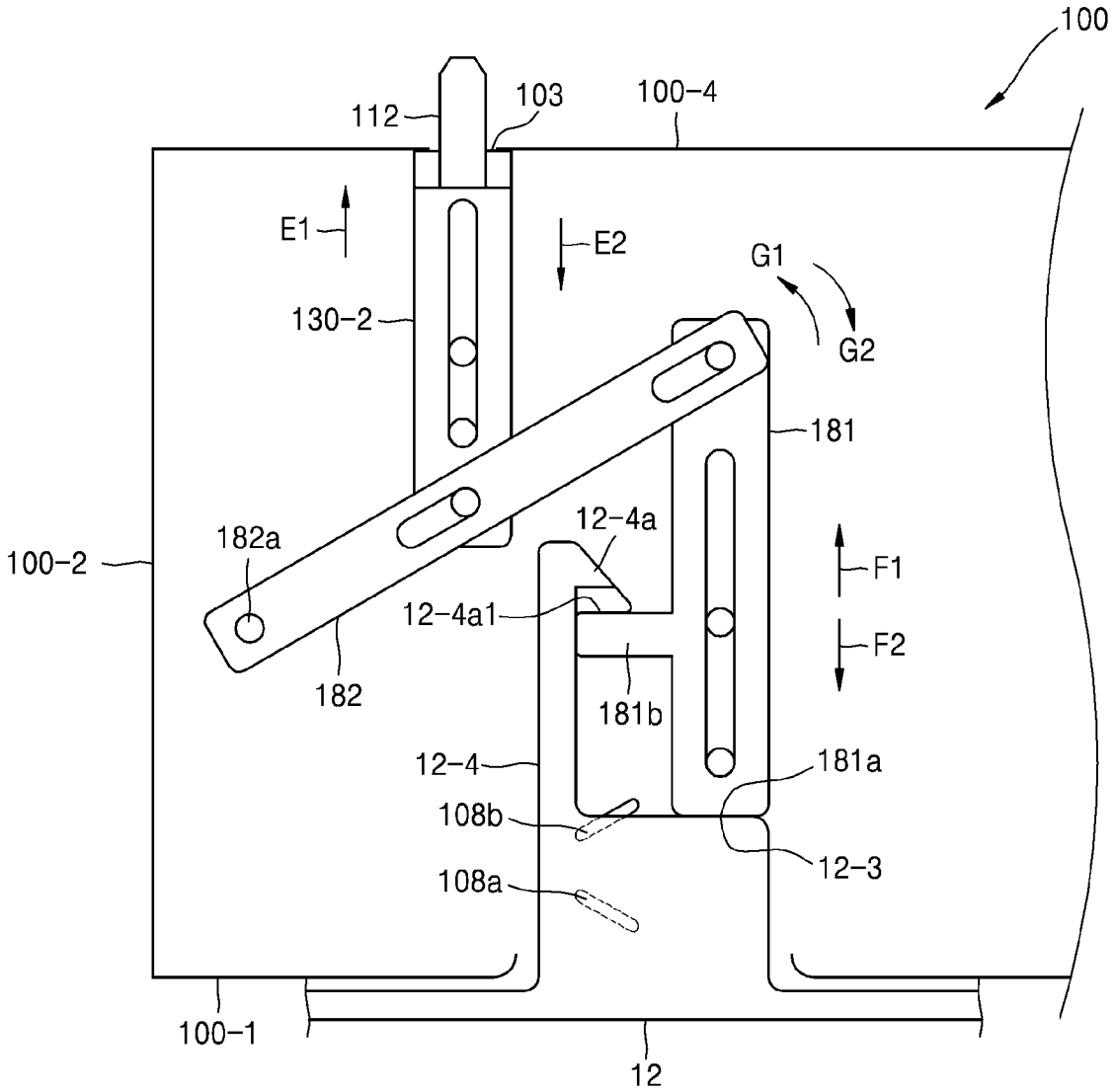

FIGS. 16A through 16C are plan views illustrating an operation of mounting or detaching the toner cartridge 100 to or from the main body 1, according to an embodiment. Operations of mounting or detaching the toner cartridge 100 to or from the main body 1 will be described with reference to FIGS. 13 and 16A through 16C.

Referring to FIG. 13, while the contact portion 112 is disposed at the first position, the door 12 is opened to insert the toner cartridge 100 into the main body 1 through the opening portion 11. When insertion of the toner cartridge 100 is completed, the door 12 is closed.

When the door 12 is closed, as illustrated in FIG. 16A, the interference portion H-1 of the hook 12-4*a* of the puling lever 12-4 contacts the first guide portion 108*a* and the pull lever 12-4 is bent and the hook 12-4*a* escapes from the second portion 181*b* of the first lever 181. The push lever 12-3 does not contact the first portion 181*a* of the first lever 181 and is separated from the first portion 181*a* of the first lever 181. Thus, the first lever 181 does not slide and the contact portion 112 is maintained at the first position.

When the door 12 is further closed, as illustrated in FIG. 16B, the hook 12-4*a* passes over the second portion 181*b* of the first lever 181 and the push lever 12-3 contacts the first portion 181*a* of the first lever 181. The puling portion 12-4*a*1 of the hook 12-4*a* may contact or be disposed adjacent to the first portion 181*b* of the first lever 181.

When the door 12 is further closed, the first lever 181 is pushed by the push lever 12-3 to slide in the direction F1, and the second lever 182 is pivoted in the direction G1 with respect to the pivot shaft 182*a*. The moving member 130-2 slides in the direction E1. When the door 12 is completely closed, as illustrated in FIG. 16C, the contact portion 112 is disposed at the second position that protrudes from the front portion 100-4 of the toner cartridge 100 and is connected to the connection portion 40 (not shown).

To detach the toner cartridge 100, the door 12 is opened in a state as illustrated in FIG. 16C. Then, the pulling portion 12-4*a*1 of the hook 12-4*a* is caught by the second portion 181*b* of the first lever 181, and the first lever 181 is pulled as the door 12 is opened. Accordingly, the first lever 181 slides in the direction F2, and the second lever 182 is pivoted in the direction G2, and the moving member 130-2 slides in the direction E2.

When the first lever 181 reaches a position illustrated in FIG. 16B, the interference portion H-1 of the hook 12-4*a* contacts the second guide portion 108*b*. Then, as illustrated in FIG. 16A, the pull lever 12-4 is bent and the pulling portion 12-4*a*1 of the hook 12-4*a* escapes from the second portion 181*b* of the first lever 181, and the first lever 181 does not slide anymore in the direction F2. When the door 12 is opened completely, the push lever 12-3 and the pulling lever 12-4 are separated from the toner cartridge 100 as illustrated in FIG. 13. In this state, the toner cartridge 100 may be removed from the main body 1.

According to the above structure, as the contact portion 112 is moved to the first and second positions via opening and closing operations of the door 12, the user does not have to move the contact portion 112 to the first and second positions. Accordingly, when mounting or detaching the toner cartridge 100 to or from the main body 1, damage to the contact portion 112 while handling the toner cartridge 100 may be prevented. In addition, as the moving member 130-2 is connected between a first end of the second lever 182 at which the pivot shaft 182*a* is disposed and a second end of the second lever 182 connected to the first lever 181, the second lever 182 may be pivoted by applying a smaller force than a resistance force applied to the second lever via the moving member 130-2 to the first lever 181. Thus, the user may open or close the door 12 with a relatively small force.

Figure 17:
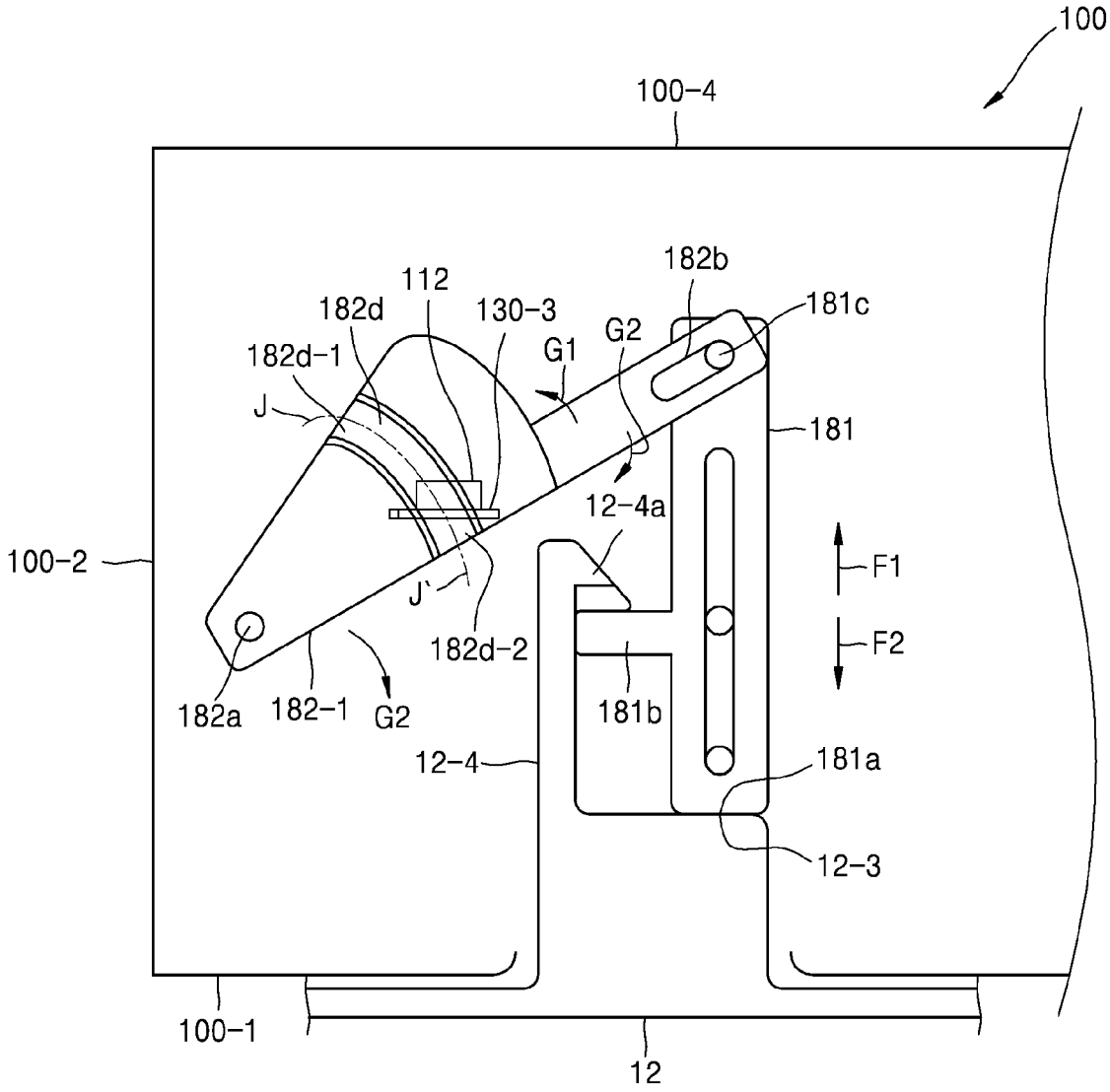
FIG. 17 is a schematic plan view illustrating an image forming apparatus having a structure in which a contact portion is moved to first and second positions in connection with opening and closing operations of a door, according to an embodiment.
Figure 18:
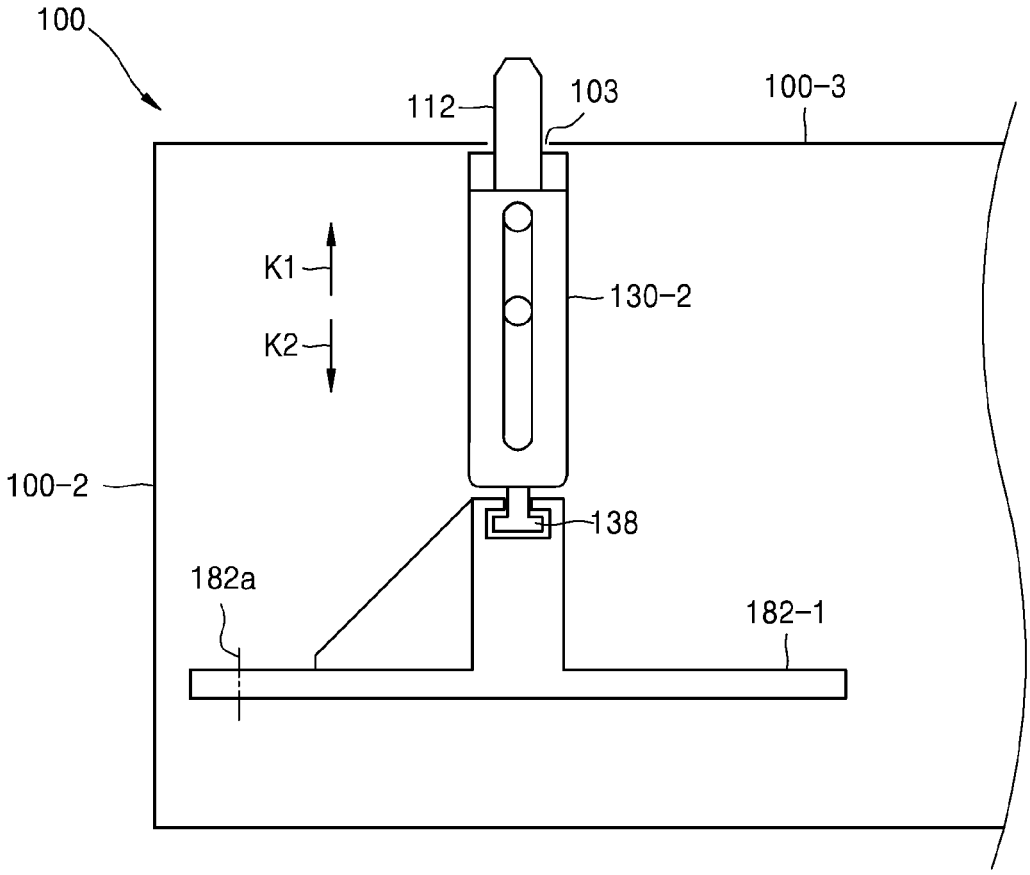
FIG. 18 is a rear view of the image forming apparatus of FIG. 17.
Figure 19:
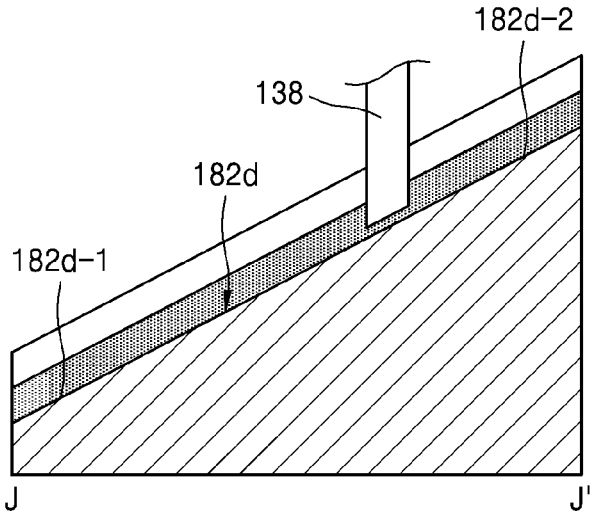
FIG. 19 is a cross-sectional view of the image forming apparatus cut along a line J-J'.

In the embodiment illustrated in FIGS. 13 through 15 and FIGS. 16A through 16C, the contact portion 112 is moved in the same direction as an opening or closing direction of the door 12, but the embodiments are not limited thereto. For example, the embodiment illustrated in FIGS. 13 through 15 and FIGS. 16A through 16C may be modified such that the contact portion 112 may is moved in a vertical direction of the toner cartridge 100 so as to be protruded from the upper portion 100-3. FIG. 17 is a schematic plan view illustrating an image forming apparatus having a structure in which the contact portion 112 is moved to first and second positions in connection with opening and closing operations of the door 12, according to an embodiment. FIG. 18 is a rear view of the image forming apparatus of FIG. 17. FIG. 19 is a cross-sectional view of the image forming apparatus cut along a line J-J'. A structure illustrated in FIGS. 17 through 19 is the same as that of the embodiment of FIGS. 13 through 15 and 16A through 16C except for a sliding direction of a moving member 130-3 and the shape of a second lever 182-1.

Referring to FIGS. 17 through 19, the moving member 130-3 on which the contact portion 112 is mounted is movably installed in the toner cartridge 100 in a vertical direction. The second lever 182-1 is connected to the first lever 181 that slides in directions F1 and F2 via opening and closing operations of the door 12 and is pivoted with respect to a pivot shaft 182*a*. A connection unit connects the moving member 130-3 and the second lever 182-1 such that, as the second lever 182-1 is pivoted in directions G1 and G2, the moving member 130-3 slides vertically, that is, in a direction that is orthogonal to a pivoting plane of the second lever 182-1. The connection unit may include, for example, a cam protrusion 138 provided on the moving member 130-3 and a cam portion 182*d* that is provided on the second lever 182-1 and guides the cam protrusion 138. The cam portion 182*d* has, for example, the form of a slot that is arc-shaped with respect to the pivot shaft 182*a* and has a height that gradually increases from a first end portion 182*d*-1 to a second end portion 182*d*-2. The cam protrusion 138 is coupled to the cam portion 182*d*. When the door 12 is opened, the cam protrusion 138 is supported by the first end portion 182*d*-1 of the cam portion 182*d*, and when the door 12 is completely closed, the cam protrusion 138 is supported by the second end portion 182*d*-2 of the cam portion 182*d*.

While the toner cartridge 100 is mounted in the main body 1, the cam protrusion 138 is disposed at the first end portion 182*d*-1 of the cam portion 182*d*, and the contact portion 112 is disposed at the first position accommodated inside the toner cartridge 100. When the door 12 is closed, the first lever 181 is pushed by the push lever 12-3 to slide in the direction F1, and the second lever 182-1 is pivoted in the direction G1. As the second lever 182-1 is pivoted in the direction G1, the cam protrusion 138 is guided by the cam portion 182*d*, and the moving member 130-3 is lifted in a direction K1. When the door 12 is completely closed, the cam protrusion 138 is supported by the second end portion 182*d*-2 of the cam portion 182*d*, and the contact portion 112 is protruded through the first exit 103 formed at the upper portion 100-3 of the toner cartridge 100 to thereby reach the second position where the contact portion 112 is connected to the connection portion 40.

When the door 12 is opened to detach the toner cartridge 100, the first lever 181 is slid in the direction F2, and the second lever 182-1 is pivoted in the direction G2. As the second lever 182-1 is pivoted in the direction G2, the cam protrusion 138 is guided by the cam portion 182*d*, and the moving member 130-3 is lowered in a direction K2. When the door 12 is opened up to a position illustrated in FIG. 16B, the cam protrusion 138 is supported by the first end portion 182*d*-1 of the cam portion 182*d*, and the contact portion 112 is released from the connection portion 40 and reaches the first position accommodated in the toner cartridge 100. When the door 12 is completely opened, as illustrated in FIG. 13, the push lever 12-3 and the pull lever 12-4 are separated from the toner cartridge 100. In this state, the toner cartridge 100 may be removed from the main body 1.

In the embodiments described above, the contact portion 112 of the memory unit 110 installed in the toner cartridge 100 is moved to the first and second positions in a structure where the toner cartridge 100 is separately replaced from the imaging unit 400. However, the embodiments are not limited thereto. Thus, the structure in which the contact portion 112 is moved to the first or second position may also be applied to the process cartridge 2 having the third structure in which the development cartridge 300 including the toner containing unit 101 is separately replaced from the photoconductor cartridge 200. In this case, the toner cartridge 100 is replaced with the development cartridge 300 in the above-described embodiments. When the development cartridge 300 is mounted in the main body 1, the memory unit 110 is electrically connected to the main body 1 to transmit information of the development cartridge 300 to the main body 1. The memory unit 110 may store various types of information of the development cartridge 300, for example, manufacturer information, manufacture date information, a serial number, or a model number, various programs, electronic signature information, and usage state (for example, a number of pages printed so far, a number of remaining printable pages, or an amount of toner left), and even the lifetime and set up menus of the development cartridge 300.

Also, the structure in which the contact portion 112 is moved to the first or second position may be applied to the process cartridge 2 having the fourth structure in which the photoconductor cartridge 200, the development cartridge 300, and the toner cartridge 100 are integrally formed. In this case, the toner cartridge 100 is replaced with the process cartridge 2 in the above-described embodiments. When the process cartridge 2 is mounted in the main body 1, the memory unit 110 is electrically connected to the main body 1 to transmit information of the process cartridge 2 to the main body 1. The memory unit 110 may store various types of information of the process cartridge 2, for example, manufacturer information, manufacture date information, a serial number, or a model number, various programs, electronic signature information, and usage state (for example, a number of pages printed so far, a number of remaining printable pages, or an amount of toner left), and even the lifetime and set up menus of the process cartridge 2.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present invention as defined by the following claims.

What is claimed is:

1. A cartridge being one of attached to and detached from a main body of an image forming apparatus which has an opening portion and a door that one of opens and closes the opening portion, the cartridge comprising:

a memory unit that includes a contact portion via which the cartridge is connected to the main body to transmit information of the cartridge to the main body;

a moving member on which the contact portion is mounted, wherein the moving member is moved to a first position where the contact portion is hidden inside the cartridge and a second position where the contact portion protrudes out of the cartridge in order to be connected to a connection portion provided in the main body; and a protection member moved as the contact portion is moved relative to the first or second position to a retreat position hidden in the cartridge and a protruding position protruding out of the cartridge where the protection member is inserted into an insertion portion provided in the main body, wherein the moving member is moved to the second position in connection with a closing operation of the door.

2. The cartridge of claim 1, wherein an inclination guide portion inclined with respect to a moving direction of the moving member is provided on the moving member, wherein when the door is closed, a push lever provided at the door pushes the inclination guide portion to move the moving member to the second position.

3. The cartridge of claim 2, further comprising an elastic member that applies an elastic force to the moving member to locate the moving member at the first position.

4. The cartridge of claim 1, wherein the moving member returns from the second position to the first position via an operation of opening the door.

5. The cartridge of claim 4, further comprising:

a first lever slid according to opening and closing operations of the door; and a second lever connected to the first lever and the moving member and is pivoted via sliding movement of the first lever to slide the moving member.

6. The cartridge of claim 5, further comprising a connection unit that connects the second lever and the moving member and the moving member slides on a same plane as a pivoting plane of the second lever.

7. The cartridge of claim 5, further comprising a connection unit that connects the second lever and the moving member and the moving member slides in a direction orthogonal to a pivoting plane of the second lever.

8. The cartridge of claim 1, wherein the protection member is inserted into the insertion portion before the contact portion is connected to the connection portion to align the contact portion and the connection portion.

9. The cartridge of claim 8, wherein a front end portion of the protection member is protruded more than a front end portion of the contact portion in a moving direction of the contact portion.

10. The cartridge of claim 1, wherein the contact portion is moved in a length direction of the cartridge orthogonal to a mounting direction of the cartridge, wherein the protection member is disposed before the contact portion in the mounting direction of the cartridge.

11. The cartridge of claim 1, wherein the protection member is integrally formed with the moving member.

12. The cartridge of claim 1, further comprising a toner containing unit containing toner.

13. The cartridge of claim 1, further comprising:

a development roller; and a toner containing unit containing toner to be supplied to the development roller.

14. The cartridge of claim 1, further comprising:

a toner containing unit containing toner;

a photoconductor on which an electrostatic latent image is formed; and a development roller that supplies the toner of the toner containing unit to the electrostatic latent image.

15. An image forming apparatus, comprising:

a main body having an opening portion;

a door that opens and closes the opening portion; and a cartridge of claim 1, wherein the cartridge is one of attached to and detached from the main body through the opening portion.

16. A cartridge being one of attached to and detached from a main body of an image forming apparatus which has an opening portion and a door that one of opens and closes the opening portion, the cartridge comprising:

a memory unit that includes a contact portion via which the cartridge is connected to the main body to transmit information of the cartridge to the main body;

a moving member on which the contact portion is mounted, and a handle pushed by a push lever provided at the door when the door is closed, the handle pivoting from a holding position protruding from the cartridge to a first accommodation position close to the cartridge, wherein the moving member is moved to a first position where the contact portion is hidden inside the cartridge and a second position where the contact portion protrudes out of the cartridge in order to be connected to a connection portion provided in the main body, wherein the moving member is moved to the second position in connection with a closing operation of the door, wherein the moving member is connected to the handle and is moved from the first position to the second position when the handle is pivoted from the holding position to the first accommodation position.

17. The cartridge of claim 16, further comprising a conversion unit that converts pivoting movement of the handle to sliding movement of the moving member.

18. The cartridge of claim 17, further comprising an accommodation portion dented where the handle located at the first accommodation position is accommodated therein.

19. The cartridge of claim 18, wherein the handle is slid from the holding position to a second accommodation position in the accommodation portion, wherein, when the handle is disposed at the holding position and the first accommodation position, a pivoting shaft of the handle is connected to the conversion unit, and wherein when the handle is located at the second accommodation position, the pivoting shaft of the handle is released from the conversion unit.

20. A cartridge being one of attached to and detached from a main body of an image forming apparatus which has an opening portion and a door that one of opens and closes the opening portion, the cartridge comprising:

a memory unit that includes a contact portion via which the cartridge is connected to the main body to transmit information of the cartridge to the main body;

a moving member on which the contact portion is mounted, a first lever slid according to opening and closing operations of the door; and a second lever connected to the first lever and the moving member and is pivoted via sliding movement of the first lever to slide the moving member;

wherein the moving member is moved to a first position where the contact portion is hidden inside the cartridge and a second position where the contact portion protrudes out of the cartridge in order to be connected to a connection portion provided in the main body, wherein the moving member is moved to the second position in connection with a closing operation of the door, wherein the moving member returns from the second position to the first position via an operation of opening the door, wherein the first lever comprises a first portion pushed by a push lever provided at the door when the door is closed and a second portion caught by a hook of a pull lever provided at the door when the door is opened.

21. The cartridge of claim 20, further comprising:

a first guide portion that allows the hook to escape from the first portion when the door is closed; and a second guide portion that allows the hook to escape from the second portion after the moving member is returned to the first position when the door is opened.

22. An image forming apparatus, comprising:

a main body having an opening portion;

a door that opens and closes the opening portion; and a cartridge one of attached to and detached from the main body through the opening portion, wherein the cartridge comprises:

a memory unit that includes a contact portion via which the cartridge is to be connected to the main body to transmit information of the cartridge to the main body;

a moving member on which the contact portion is mounted; and a protection member moved as the contact portion is moved relative to the first or second position to a retreat position hidden in the cartridge and a protruding position protruding out of the cartridge where the protection member is inserted into an insertion portion provided in the main body, wherein the moving member is moved to a first position where the contact portion is hidden inside the cartridge and a second position where the contact portion protrudes out of the cartridge for the contact portion to be connected to the connection portion, wherein the moving member is moved to the first position and the second position in connection with opening and closing operations of the door.

23. The image forming apparatus of claim 22, wherein the cartridge comprises a first lever that slides according to opening and closing operations of the door and a second lever connected to the moving member and pivoted according to a sliding operation of the first lever to slide the moving member.

24. The image forming apparatus of claim 23, wherein the cartridge comprises a connection unit that connects the second lever and the moving member where the moving member slides within a same plane as a pivoting plane of the second lever.

25. The image forming apparatus of claim 23, wherein the cartridge comprises a connection unit that connects the second lever and the moving member where the moving member slides in a direction orthogonal to a pivoting plane of the second lever.

26. An image forming apparatus, comprising:

a main body having an opening portion;

a door that opens and closes the opening portion; and a cartridge one of attached to and detached from the main body through the opening portion, wherein the cartridge comprises:

a memory unit that includes a contact portion via which the cartridge is to be connected to the main body to transmit information of the cartridge to the main body; and a moving member on which the contact portion is mounted, wherein the moving member is moved to a first position where the contact portion is hidden inside the cartridge and a second position where the contact portion protrudes out of the cartridge for the contact portion to be connected to the connection portion, wherein the moving member is moved to the first position and the second position in connection with opening and closing operations of the door, wherein the cartridge comprises a first lever that slides according to opening and closing operations of the door and a second lever connected to the moving member and pivoted according to a sliding operation of the first lever to slide the moving member, wherein a push lever and a pull lever are provided at the door, wherein the push lever pushes the first lever when the door is closed and the pull lever comprises a hook that pulls the first lever when the door is opened.

27. The image forming apparatus of claim 26, wherein the first lever comprises a first portion pushed by the push lever when the door is closed and a second portion caught by the hook when the door is opened.

28. The image forming apparatus of claim 27, wherein the cartridge comprises a first guide portion that allows the hook to escape from the first portion when the door is closed and a second guide portion that allows the hook to escape from the second portion after the moving member is returned to the first position when the door is opened.

29. The image forming apparatus of claim 28, wherein the pull lever comprises an elastic arm elastically pivoted by interfering with the first and second guide portions.

30. The image forming apparatus of claim 28, wherein the pull lever comprises a pivoting arm pivotably installed with respect to a pivot shaft provided at the door and pivoted by interfering with the first and second guide portions.

31. The image forming apparatus of claim 28, wherein the hook comprises an interference portion that interferes with the second guide portion, a non-interference portion that does not interfere with the second guide portion, and a puling portion provided in the non-interference portion and hooked on the second portion of the first lever when the door is opened.

32. A cartridge, comprising:

a memory unit having a contact portion electrically connectable to a connector of a main body of an image forming apparatus to transmit information of the cartridge to the main body;

a moving member apparatus extending the contact portion outside the cartridge into the connector when a door of the main body is closed; and a protection member moved as the contact portion is extended outside the cartridge from a retreat position hidden in the cartridge to a protruding position protruding out of the cartridge where the protection member is inserted into an insertion portion provided in the main body.

33. The cartridge of claim 32, wherein the moving member comprises an inclined plane attached to the contact portion and a push lever that contacts the plane and forces the plane toward the connector when the door is closed.

34. The cartridge of claim 33, wherein the inclined plane comprises a guide grove and the moving member is bi-directionally moved by a guide post sliding in the guide groove.

35. The cartridge of claim 32, wherein the moving member comprises:

a rack gear attached to the contact portion;

a pinion gear attached to the rack gear; and a push lever attached to the pinion gear.

36. The cartridge of claim 32, wherein the moving member comprises:

a first slide attached to contact portion;

a lever slidably engaged with first slide; and a second slide slidably engaged with the lever and operated by motion of a door of the main body.

37. A cartridge, comprising:

a memory unit having a contact portion electrically connectable to a connector of a main body of an image forming apparatus to transmit information of the cartridge to the main body; and a moving member apparatus extending the contact portion outside the cartridge into the connector when a door of the main body is closed, wherein the moving member comprises:

a rack gear attached to the contact portion;

a pinion gear attached to the rack gear; and a push lever attached to the pinion gear, wherein the lever is coupled to a cartridge user handle used in inserting the cartridge into the main body and the lever is operated by the handle.

38. A cartridge, comprising:

a memory unit having a contact portion electrically connectable to a connector of a main body of an image forming apparatus to transmit information of the cartridge to the main body; and a moving member apparatus extending the contact portion outside the cartridge into the connector when a door of the main body is closed, wherein the moving member comprises:

a rack gear attached to the contact portion;

a spur gear attached to the rack gear;

a bevel gear attached to the spur gear;

a pinion gear attached to the spur gear; and a cartridge user handle used in inserting the cartridge into the main body and attached to the pinion gear.

39. A cartridge, comprising:

a memory unit having a contact portion electrically connectable to a connector of a main body of an image forming apparatus to transmit information of the cartridge to the main body; and a moving member apparatus extending the contact portion outside the cartridge into the connector when a door of the main body is closed, wherein the moving member comprises:

a first slide attached to contact portion;

a lever engaged with first slide via a cam moving in an arc shaped slot; and a second slide slidably engaged with the lever and operated by motion of a door of the main body.

* * * * *

UNITED STATES PATENT AND TRADEMARK OFFICE

CERTIFICATE OF CORRECTION

PATENT NO. : 9,235,188 B2
APPLICATION NO. : 14/462737
DATED : January 12, 2016
INVENTOR(S) : Ji-won Moon et al.

It is certified that error appears in the above-identified patent and that said Letters Patent is hereby corrected as shown below:

Claims

Column 27, Line 5, Claim 19
Delete "wherein" and insert -- wherein, --, therefore.

Signed and Sealed this
Seventeenth Day of May, 2016

Michelle K. Lee

Michelle K. Lee
*Director of the United States Patent and Trademark Office*